US009033098B2

(12) United States Patent
Bridge et al.

(10) Patent No.: US 9,033,098 B2
(45) Date of Patent: May 19, 2015

(54) VERTICAL LINE ARRAY LOUDSPEAKER MOUNTING AND ADJUSTMENT SYSTEM

(71) Applicant: PK Event Services Inc., Calgary (CA)

(72) Inventors: Jeremy Bridge, Calgary (CA); Jonathan Bichel, Calgary (CA)

(73) Assignee: PK Event Services Inc., Alberta (CA)

( * ) Notice: Subject to any disclaimer, the term of this patent is extended or adjusted under 35 U.S.C. 154(b) by 0 days.

(21) Appl. No.: 14/291,906

(22) Filed: May 30, 2014

(65) Prior Publication Data

US 2014/0353074 A1 Dec. 4, 2014

Related U.S. Application Data

(60) Provisional application No. 61/829,110, filed on May 30, 2013.

(51) Int. Cl.
*H04R 29/00* (2006.01)
*H04R 31/00* (2006.01)

(52) U.S. Cl.
CPC ..... *H04R 31/006* (2013.01); *H04R 29/002* (2013.01)

(58) Field of Classification Search
CPC . H04R 29/002; H04R 2201/025; H04R 1/026
See application file for complete search history.

(56) References Cited

U.S. PATENT DOCUMENTS

| | | | | |
|---|---|---|---|---|
| 5,418,338 | A | 5/1995 | Kim | |
| 5,819,959 | A | 10/1998 | Martin | |
| 6,215,883 | B1 | 4/2001 | Leonarz | |
| 6,652,046 | B2 | 11/2003 | Christner | |
| 6,792,117 | B2 | 9/2004 | Liu | |
| 7,036,781 | B1 * | 5/2006 | Bothe | 248/291.1 |
| 7,261,180 | B1 | 8/2007 | Faranda et al. | |
| 7,706,558 | B2 | 4/2010 | Sack et al. | |
| 8,170,263 | B2 | 5/2012 | Engebretson et al. | |
| 2006/0169530 | A1 | 8/2006 | Noselli et al. | |
| 2007/0000719 | A1 * | 1/2007 | Bothe | 181/150 |
| 2010/0158287 | A1 | 6/2010 | Xu et al. | |

OTHER PUBLICATIONS

International Search Report and Written Opinion of the International Searching Authority of Jul. 18, 2014.

* cited by examiner

*Primary Examiner* — Jeremy Luks

(74) *Attorney, Agent, or Firm* — McGlew and Tuttle, P.C.

(57) ABSTRACT

The invention relates to a loudspeaker mounting and adjustment system and method for installing and operating a professional audio system used in a stadium, concert hall or the like. The system comprises a vertical array of loudspeaker cabinets that can be suspended from a ceiling and that enables the horizontal and vertical angle of the sound dispersion field to be adjusted remotely and/or automatically while the system is suspended. Each loudspeaker cabinet is connected to a vertically adjacent loudspeaker cabinet via a pair of levers located on either side of the cabinet that control the angle between adjacent loudspeaker cabinets. A linear actuator is connected to each lever for controlling the lever position. Each loudspeaker cabinet also comprises a waveguide with at least one actuator for modifying the waveguide angle and thus the horizontal angle of the sound dispersion field.

26 Claims, 19 Drawing Sheets

VERTICAL LINE ARRAY LOUDSPEAKER MOUNTING AND ADJUSTMENT SYSTEM

CROSS-REFERENCE TO RELATED APPLICATION

This application claims the benefit of U.S. Provisional Application No. 61/829,110, filed May 30, 2013, the entire contents of which are incorporated herein by reference.

FIELD OF THE INVENTION

The invention relates to a loudspeaker mounting and adjustment system and method for installing and operating a professional audio system used in a stadium, concert hall or the like. The system comprises a vertical array of loudspeaker cabinets that can be suspended from a ceiling and that enables the horizontal and vertical angle of the sound dispersion field to be adjusted remotely and/or automatically while the system is suspended.

BACKGROUND OF THE INVENTION

Professional audio systems are used in stadiums or halls with tiered seating that hold sporting events, concerts and the like. These audio systems typically comprise a number of loudspeaker cabinets that are hung from the stadium ceiling above and around the seating area, generally in a number of vertical arrays in order that all of the spectators receive relatively consistent audio volume and quality irrespective of their location within the stadium. Generally, the loudspeaker cabinets in each array are positioned at various angles with respect to the vertically adjacent loudspeaker cabinets in the array in order to focus the sound field as directly as possible towards the spectators in the tiered seating below. In many stadiums this will generally result in a curved or "J" shaped vertical array.

After the initial installation of a vertical array of speakers, it is generally difficult to adjust the various angles between loudspeaker cabinets in a hanging system due to the significant weight of the cabinets and the inaccessibility of the cabinets when they are hanging in mid-air. In many stadiums or halls, an array of speaker cabinets may be anywhere from 20-200 feet above the seating. As such, many loudspeaker systems require the angle of each loudspeaker cabinet to be calculated and manually adjusted prior to the cabinets being hung. These calculations and adjustments can be difficult and time-consuming, as they require the details of the stadium, the use of prediction software, and sufficient time in advance to calculate and prepare the loudspeaker cabinets for hanging. There may also be errors in the calculation, unaccounted for variables, and/or a lack of information that causes the sound field of the speakers after hanging to be less than optimal. This may result in inferior sound dispersion, as it is unlikely that the speakers will be taken down and re-adjusted due to the difficulty and time required to do so.

A review of the prior art reveals different designs of speaker hanging systems that provide various features to the designers and operators of speaker arrays. For example, U.S. Pat. No. 8,170,263 describes a rigging system that can rigidly maintain the angles between speakers in a line array, however the angles must be manually adjusted prior to suspension.

There are some loudspeaker systems that can be manually adjusted after they have been hung, as described in U.S. Pat. Nos. 7,216,180 and 5,819,959. However there are disadvantages to these systems as it can be very difficult to access the loudspeaker systems while they are hanging in order to adjust the speaker angles. There is also a safety concern in adjusting the speakers, as adjustment typically requires a worker to manually connect small moving parts located on very heavy columns of speakers, and the worker's fingers are often at risk of getting crushed. Furthermore, these systems often require the speaker angle to be grossly adjusted prior to hanging and then fine-tuned after hanging. Adjusting the speaker angles on more than one occasion during the set-up process can be time-consuming and inefficient, and still requires a prediction of the optimal speaker angle.

There are also loudspeaker systems that enable the angle of the loudspeaker cabinets to be adjusted remotely while the cabinets are hanging, for example as described in U.S. Pat. Nos. 6,652,046; 7,706,558; and US Patent Publication No. 2006/0169530. These systems generally have a hinge or pivot point connecting the front side of adjacent cabinets, and a pair of actuators located at the rear of each cabinet. There are several disadvantages to this type of set-up due to the weight distribution of a typical vertical speaker array. Specifically, the curved or "J" shaped fashion of an installed vertical speaker array results in the center of gravity of the array being moved rearward, thereby placing the largest fraction of the overall weight of the system supported by the rear rigging connections. In some cases, all of the speakers' weight is transferred through the rear rigging connection. This can be significant as a typical large scale loudspeaker array can contain up to 24 speakers generally weighing around 225 lbs (~100 kg) each, creating a total speaker array weight of approximately 5400 lbs (~2400 kg) in total weight. Prior art systems typically place the actuators at the rear of each cabinet, such that the actuators are the main connection link between adjacent cabinets. If a pair of actuators is used to support a 5400 lb (2400 kg) array, each actuator would typically need to be rated to carry 13,500 lbs (6100 kg) in order to meet the general industry safety regulations that require a 5:1 ratio for supporting an overhead load (5400 lbs/2 actuators multiplied by 5). An actuator rated to carry 13,500 lbs. would generally exceed the limits of an economically viable actuator that would be sized appropriately. As such, the prior art systems having an adjustable connection at the rear of the speaker cabinets would typically only be able to be adjusted when there is no load on the system.

Other prior art systems teach a variety of generally adjustable speaker systems, including U.S. Pat. Nos. 6,215,883; 6,792,117; US Patent Publication No. 2010/0158287; and U.S. Pat. No. 5,418,338. However these speaker systems are not directed to a hanging array of stadium loudspeakers and do not address the specific problems described above.

As such, there is a need for a loudspeaker system wherein the angle between vertically adjacent loudspeaker cabinets can be remotely adjusted after the loudspeaker system is hanging. There is a further need for a loudspeaker system wherein the load on the actuator is reduced in order to improve the safety of the system and make it more economically viable.

SUMMARY OF THE INVENTION

In accordance with the invention, there is provided a system and method adjusting the angle of adjacent speaker cabinets in a line array. In accordance with one aspect of the invention, there is a provided a speaker system comprising at least one speaker cabinet, the at least one speaker cabinet comprising an enclosure having opposing sidewalls and a connection mechanism attached to each sidewall for connection to at least one adjacent speaker cabinet, each connection mechanism including a lever having a first end and a second end, the first end pivotably connected to the enclosure at a pivot point about which the lever is pivotable between a neutral position and an angled position; and an actuator operatively connected to the first end of the lever for pivoting the lever between the neutral position and the angled position; wherein the lever is configured for connection to an adjacent lower speaker cabinet for changing the angle of the lower speaker cabinet with respect to the at least one speaker cabinet about a horizontal axis; wherein the pivot point is located along the sidewall to the rear of the center of gravity of the enclosure.

In one embodiment of the invention, the lever second ends are located at or substantially adjacent the rear of the enclosure.

In one embodiment, the actuators are linear actuators and a direction of actuation is generally perpendicular to the levers when the levers are in the neutral position. In another embodiment, the actuators have a direction of actuation generally parallel to the levers in the neutral position, and the actuators are operatively connected to the lever by a second lever pivotably connected to the sidewall.

The actuators may be directly connected to the levers, or they may be connected to the levers via one or more linking members. The one or more linking members may include at least one second lever operatively connected to the sidewall for reducing the actuation force required to move the levers. There may also be at least one linking member operatively connected between each lever and second lever.

In one embodiment, when the levers are in the neutral position, they are positioned for connecting the lower speaker cabinet at a 0° angle to the at least one speaker cabinet. In the angled position, the first levers may be positioned at approximately a 10° angle with respect to the at least one speaker cabinet.

In another embodiment of the invention, at least two speaker cabinets are stacked vertically to form a line array and the levers of an upper speaker cabinet are operatively connected to the connection mechanisms of a lower speaker cabinet for pivoting the lower speaker cabinet with respect to the upper speaker cabinet about a horizontal axis.

In one embodiment, the speaker system further comprises a control system for controlling the movement of the actuators. The actuators may operate substantially simultaneously by means of the control system. The actuators may also be remote controllable.

In yet another embodiment, the speaker system further comprises a waveguide having two waveguide walls, each waveguide wall independently and pivotably connected to the front side of the enclosure for directing a sound array from the speaker cabinet. Each waveguide wall may be pivotable between 15° and 70° about a vertical axis from a line bisecting the speaker cabinet. There may also be a pair of waveguide actuators, each waveguide actuator operatively connected to one of the waveguide walls and to the enclosure for pivoting the waveguide wall.

In one embodiment, the connection mechanism further comprises a stopping device for preventing the lever from pivoting beyond a maximum angle. The stopping device may include at least one slot and pin.

In another aspect of the invention, there is provided a method for automatically adjusting a sound array field on a vertical and a horizontal plane for a vertical line array speaker system comprising the steps of: a) assembling a plurality of speaker cabinets to form a vertical line array speaker system and stacking or suspending the speaker system in a venue; b) inputting into a computer system a 3-dimensional plot of the venue and the location of each speaker cabinet; c) assigning virtual microphones throughout the venue where an audience would be located; d) measuring 3-dimensional polar dispersion for a first speaker cabinet using the virtual microphones, wherein the first speaker cabinet is the uppermost speaker cabinet in the vertical line array speaker system; e) automatically adjusting the sound dispersion field for the first speaker cabinet to optimize the 3-dimensional polar dispersion of the first speaker cabinet; and f) repeating steps d) and e) for each speaker cabinet in the vertical line array speaker system, proceeding from the uppermost speaker cabinet to the lowermost speaker cabinet.

In one embodiment, in step e) the sound dispersion field for each speaker cabinet is adjusted horizontally and vertically.

In another embodiment, in step b) the location of each speaker cabinet is automatically calculated by inputting the specifications of the vertical line array speaker system. The location of the audience in the venue may also be inputted into the computer system in step b).

In yet another embodiment, there is a plurality of vertical line array speaker systems stacked or suspended in the venue, and steps d) to f) are repeated for each vertical line array speaker system.

BRIEF DESCRIPTION OF THE DRAWINGS

The invention is described with reference to the accompanying figures in which.

DETAILED DESCRIPTION OF THE INVENTION

With reference to the figures, a line array speaker system 10 comprising a plurality of substantially identical speaker cabinets 12 connected in a vertical line is described.

The Speaker Cabinet

Referring to FIGS. 5A, 7A, 8, 17A and 18, each speaker cabinet generally comprises a housing or enclosure 14 having a front side 14*a*, a top side 14*b*, a rear side 14*c*, two sidewalls 14*d* and a bottom side 14*e*. A speaker driver or multiple speaker drivers (not shown) are located inside the enclosure for converting electrical energy to sound waves. A waveguide 18 having a first and second wall 18*a*, 18*b* directs the sound emitted from the speaker. The walls of the waveguide are generally vertical and diverge away from the sides of the speaker.

Figure 5A:
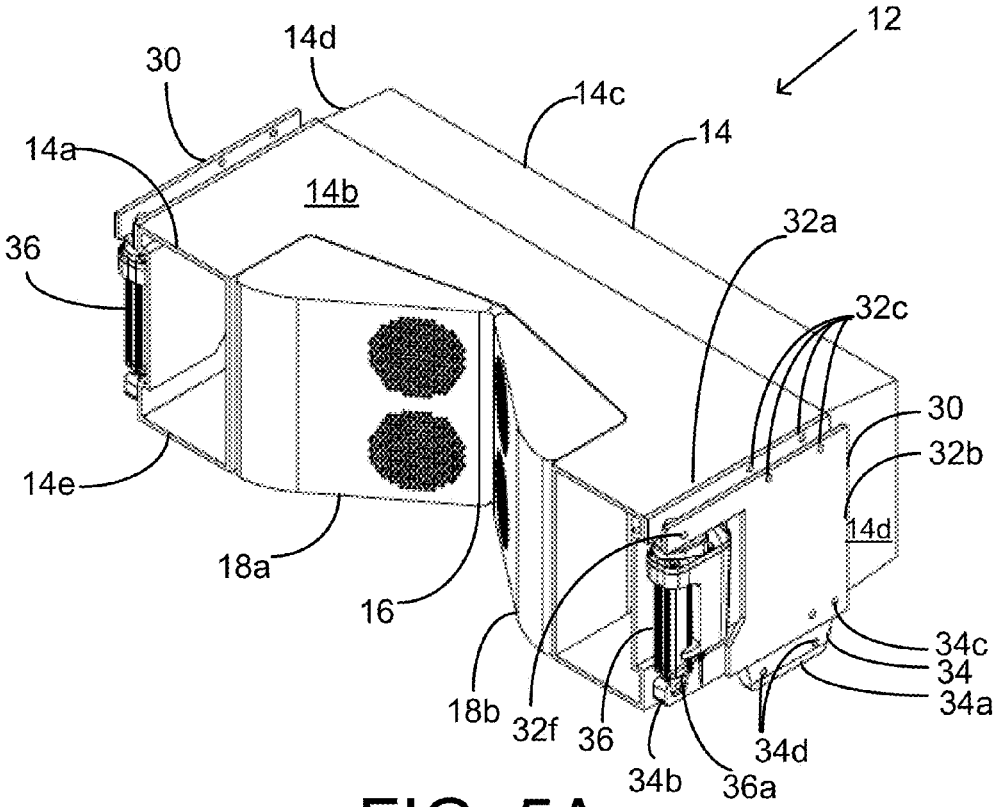
FIG. 5A is a front perspective view of a speaker cabinet having waveguide walls in an open position in accordance with one embodiment of the invention.
Figure 5B:
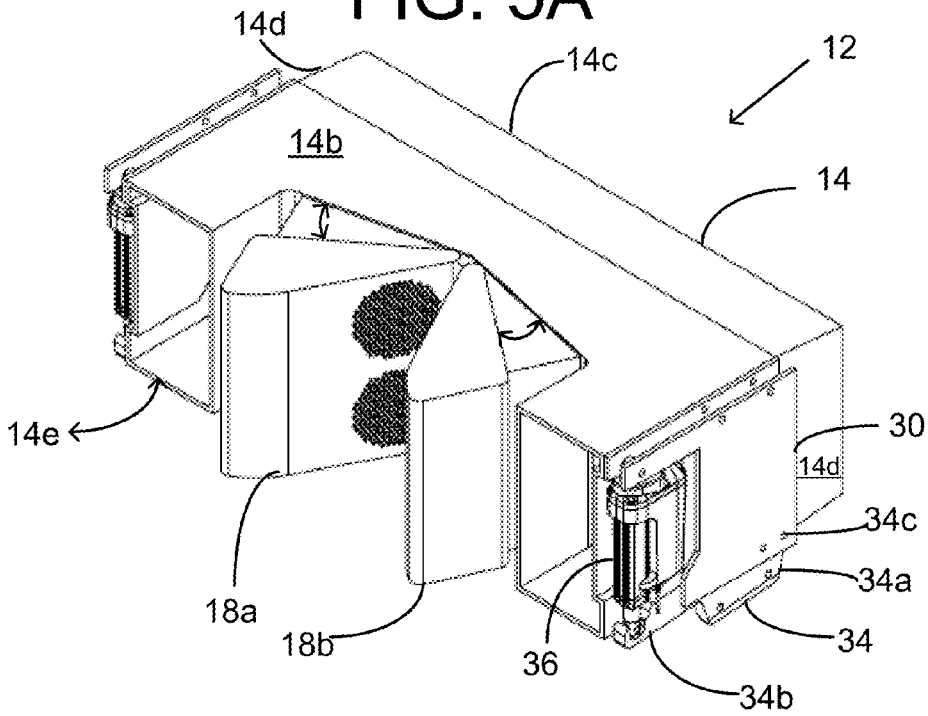
FIG. 5B is a front perspective view of a speaker cabinet with the waveguide walls in an inward position in accordance with one embodiment of the invention.
Figure 6A:
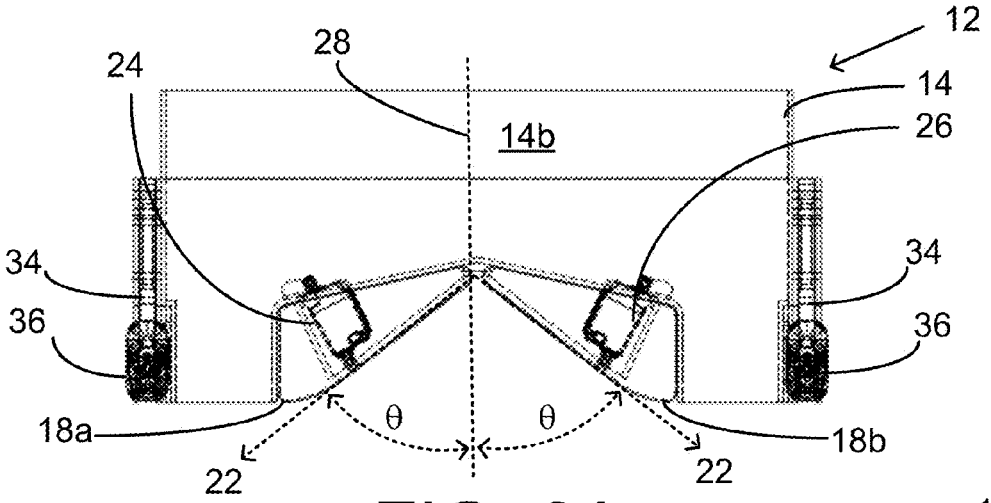
FIG. 6A is a top view of a speaker cabinet with the waveguide walls in an open position in accordance with one embodiment of the invention.
Figure 6B:
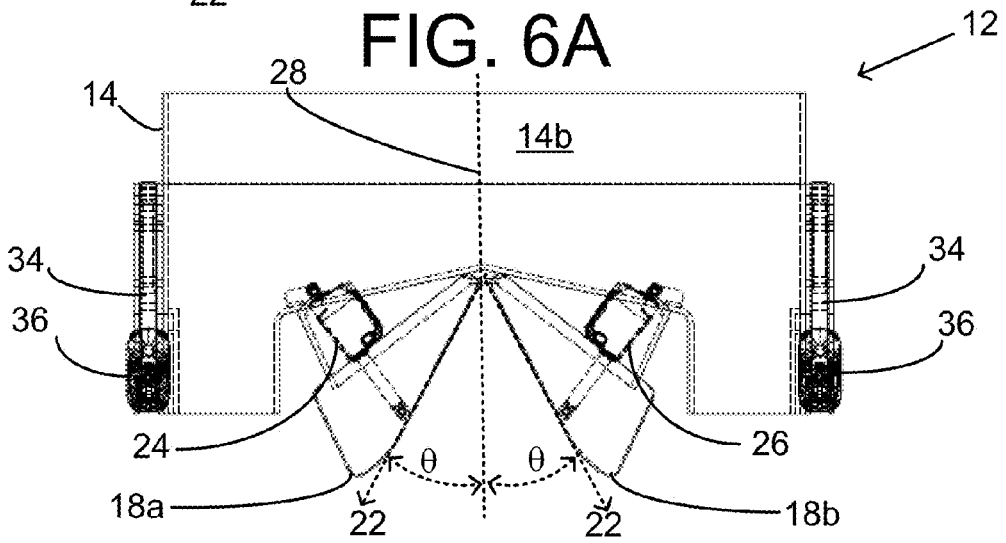
FIG. 6B is a top view of a speaker cabinet with the waveguide walls in an inward position in accordance with one embodiment of the invention.
Figure 6C:
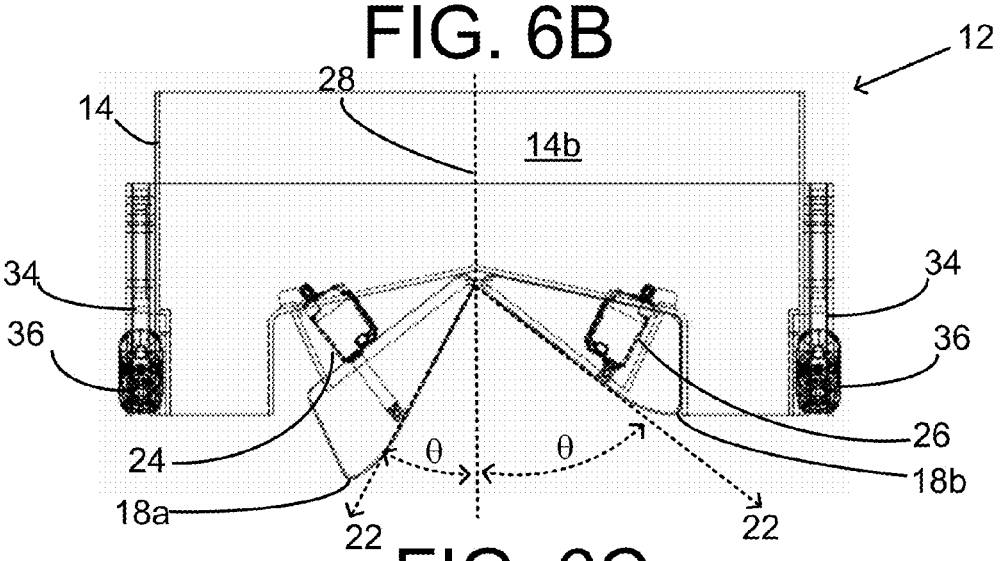
FIG. 6C is a top view of a speaker cabinet with the waveguide walls adjusted asymmetrically in accordance with one embodiment of the invention.

Each waveguide wall 18*a*, 18*b* is movably connected to the enclosure 14, and is preferably independently and pivotally connected to the enclosure via a waveguide hinge 20. The waveguide walls are moveable between an open position, shown in FIGS. 5A and 6A, and an inward position shown in FIGS. 5B and 6B. Preferably, in the open position, the waveguide walls are positioned substantially flat against the front side of the enclosure, and in the inward position, the waveguide walls are pivoted inwards about a vertical axis. Adjusting the angle of the waveguide walls adjusts the horizontal angle θ of sound dispersion field 22 from the speaker, as illustrated in FIGS. 6A, 6B and 6C. The waveguide walls can be varied symmetrically (FIGS. 6A, 6B) or asymmetrically (FIG. 6C) to modify the sound dispersion field about a vertical axis, and each waveguide wall can be positioned at any angle θ between an open position and an inward position. In one embodiment, from a vertical plane 28 bisecting the speaker cabinet, each waveguide wall is moveable between 15° in the inward position and 70° in the open position. More specifically, each waveguide wall is moveable between 20° and 65°. Even more specifically, each waveguide wall is moveable between 25° and 60°. The total horizontal sound array field is determined by the sum of the angle of each waveguide wall from the vertical plane 28. For example, if one waveguide wall is in the open position at 60° and the other waveguide wall is in the closed position at 25°, the total horizontal sound array field is 85°.

Referring to FIGS. 6A, 6B, 6C, in one embodiment the system includes a pair of linear waveguide actuators 24, 26, each waveguide actuator connecting a waveguide wall to the enclosure. Extension of a waveguide actuator moves the waveguide wall inwardly towards the inward position, and retraction of the waveguide actuator opens the waveguide wall up into the open position, or to any position between the inward and open position. The waveguide actuators may be electromechanical or hydraulic actuators and may be controlled remotely for adjusting the angle of each waveguide wall independently.

Speaker Connection System

Figure 1:
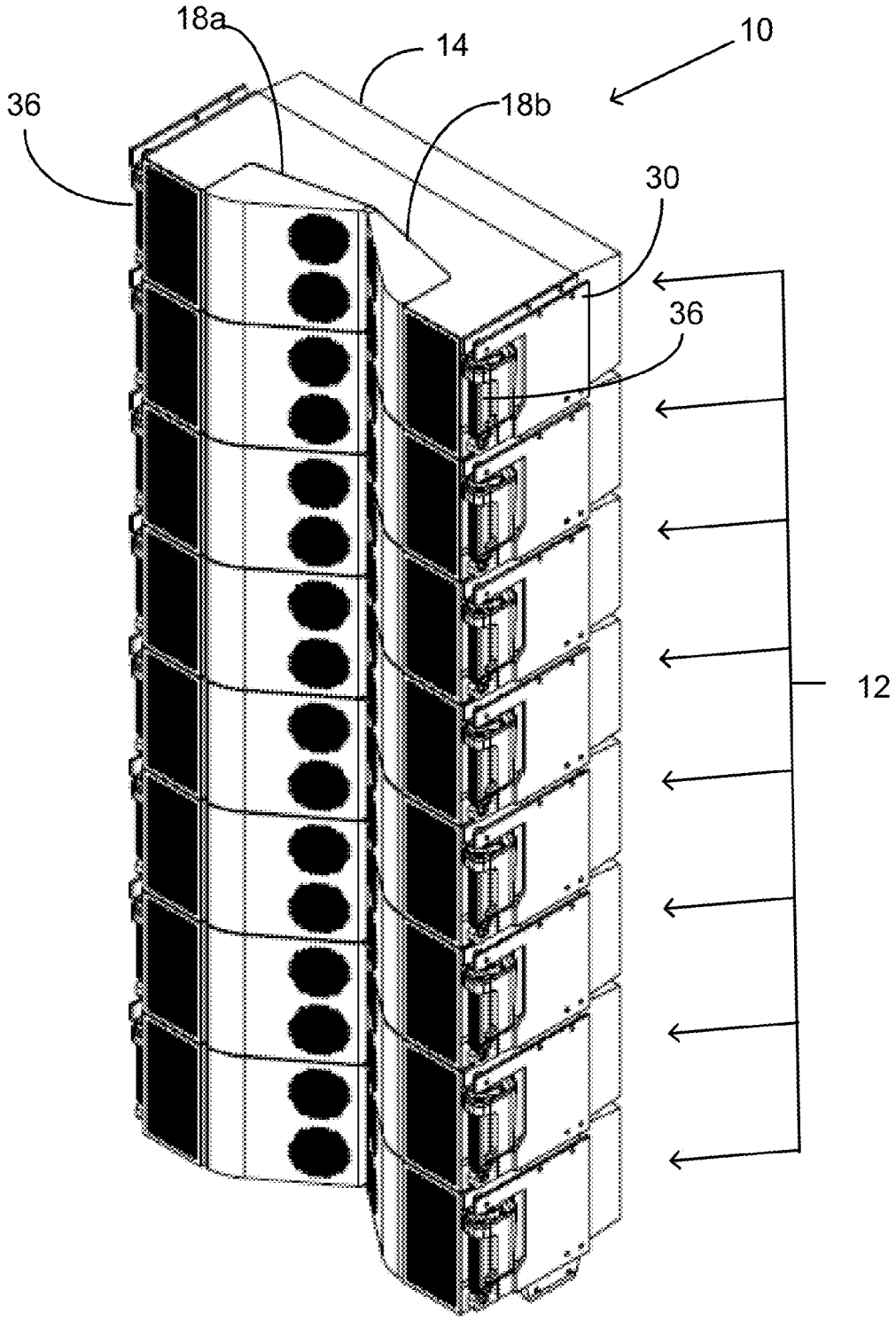
FIG. 1 is a front perspective view of a line array speaker system in a straight position having waveguide walls in an open position in accordance with one embodiment of the invention.
Figure 2B:
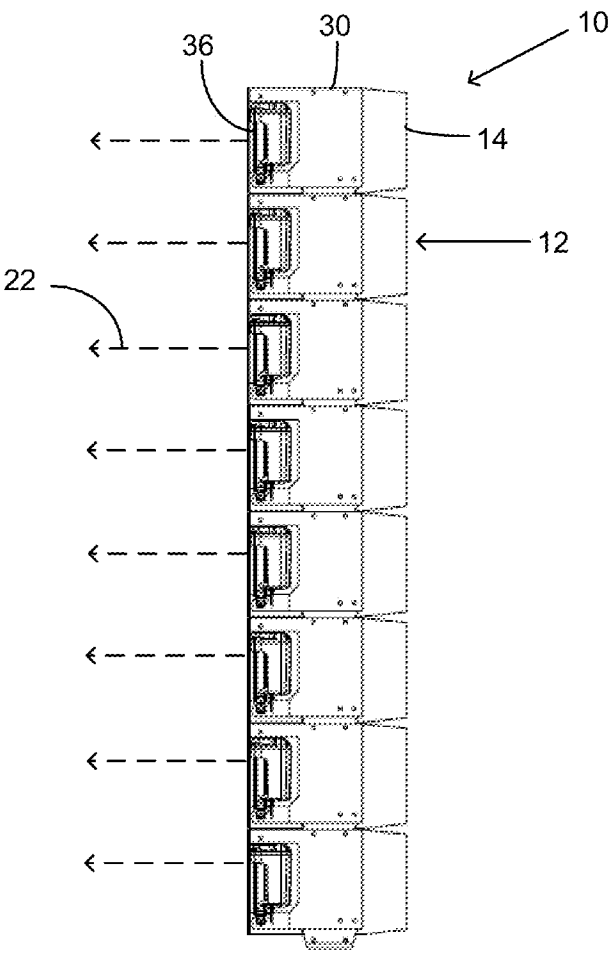
FIG. 2B is a side view of a line array speaker system in a straight position with the waveguide walls in an open position in accordance with one embodiment of the invention.
Figure 2A:
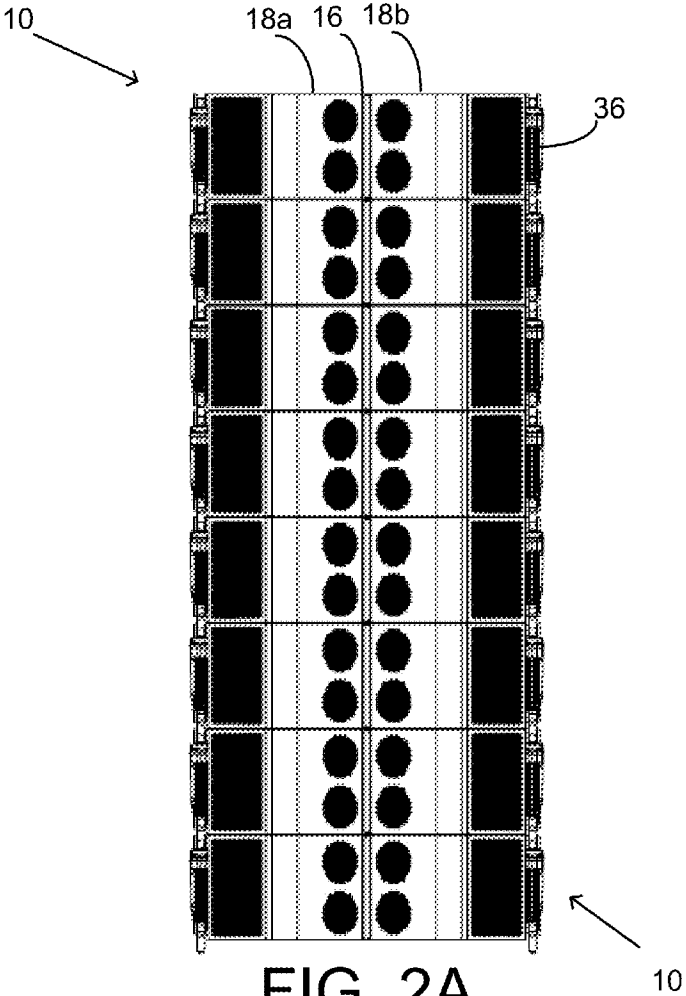
FIG. 2A is a front view of a line array speaker system in a straight position with the waveguide walls in an open position in accordance with one embodiment of the invention.
Figure 3:
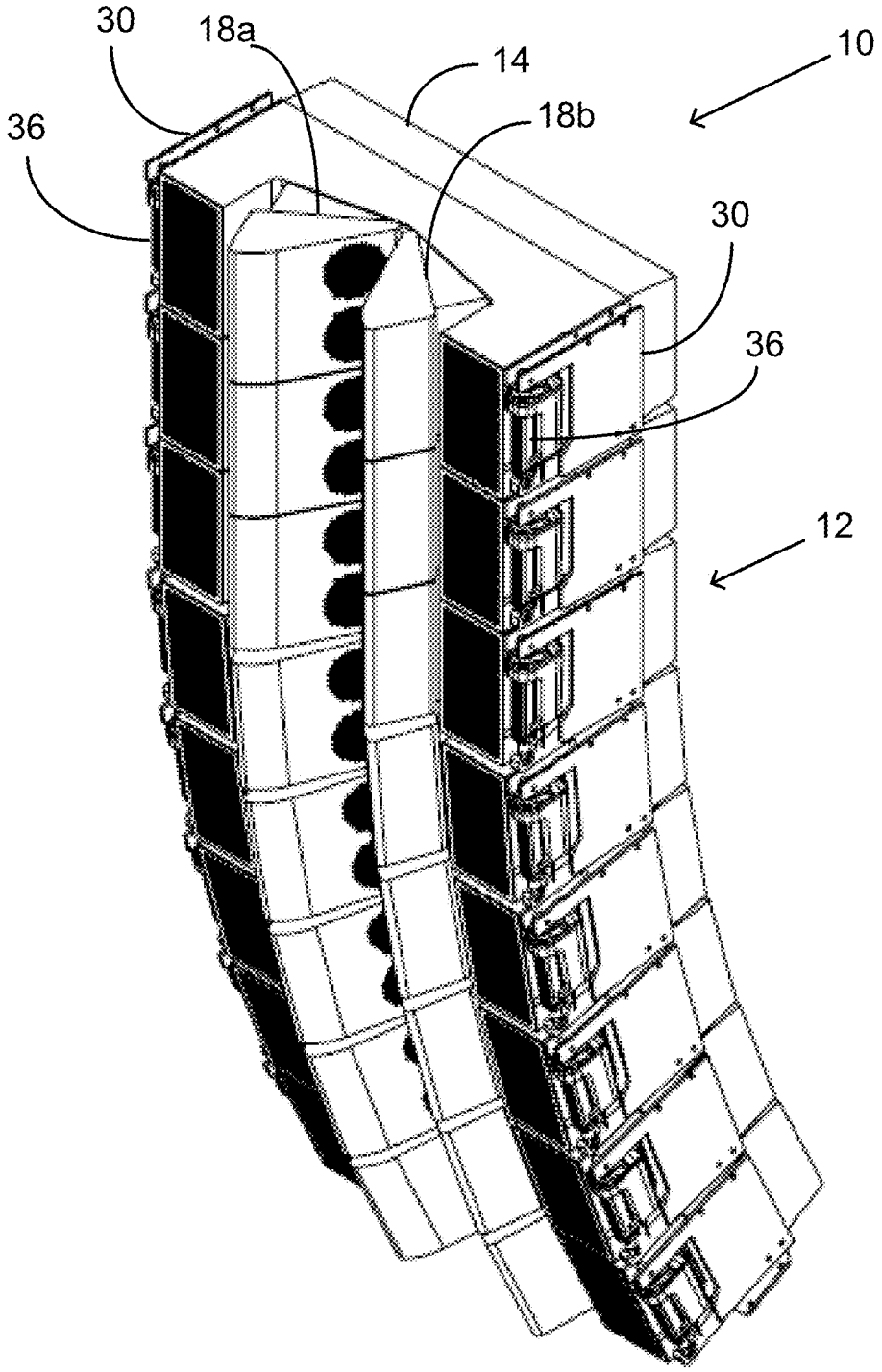
FIG. 3 is a front perspective view of a line array speaker system in a curved position with the waveguide walls progressively moving from an open position to an inward position in accordance with one embodiment of the invention.
Figure 15:
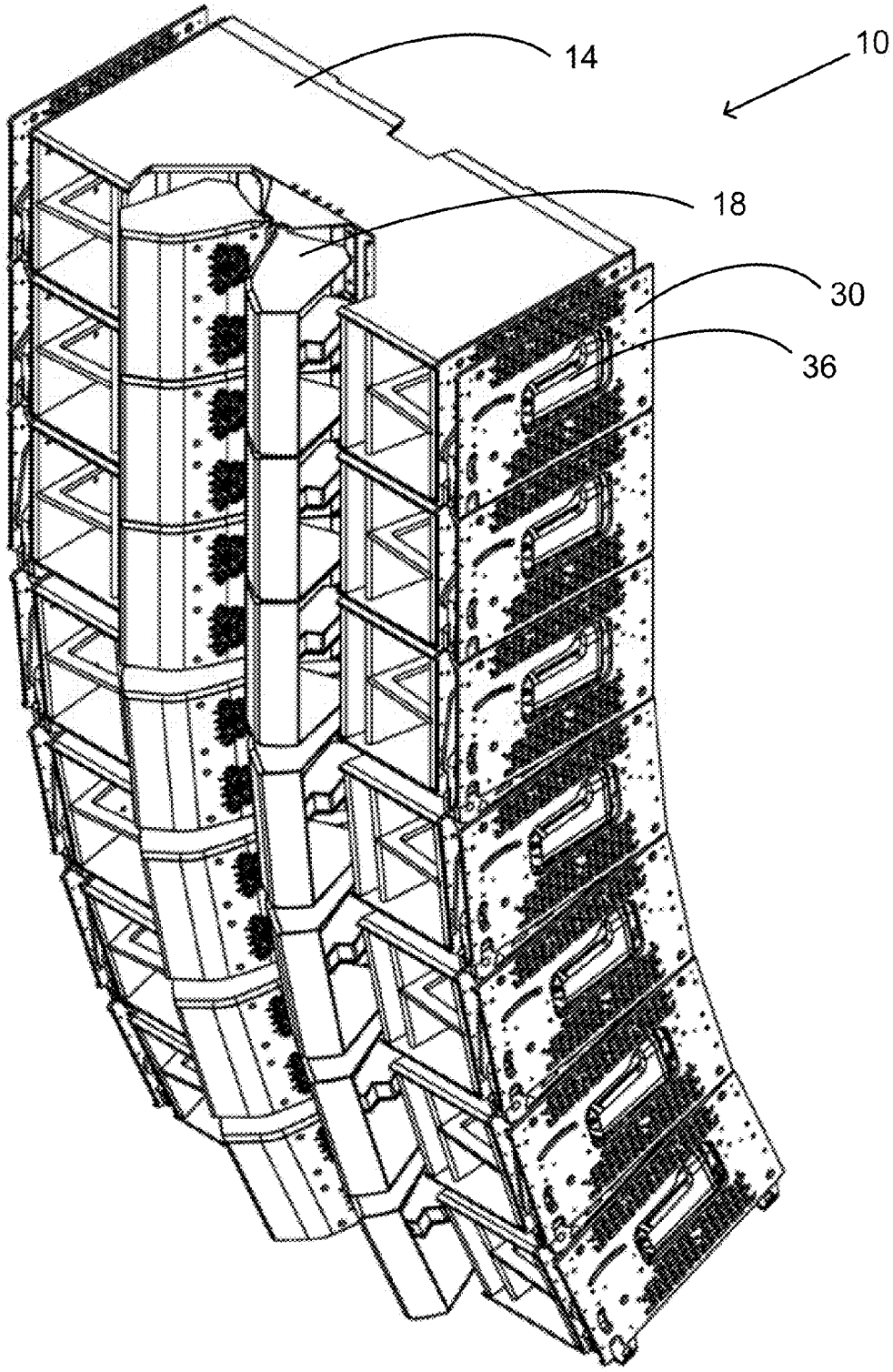
FIG. 15 is a front perspective view of the line array speaker system of FIG. 14 in a curved position.
Figure 16A:
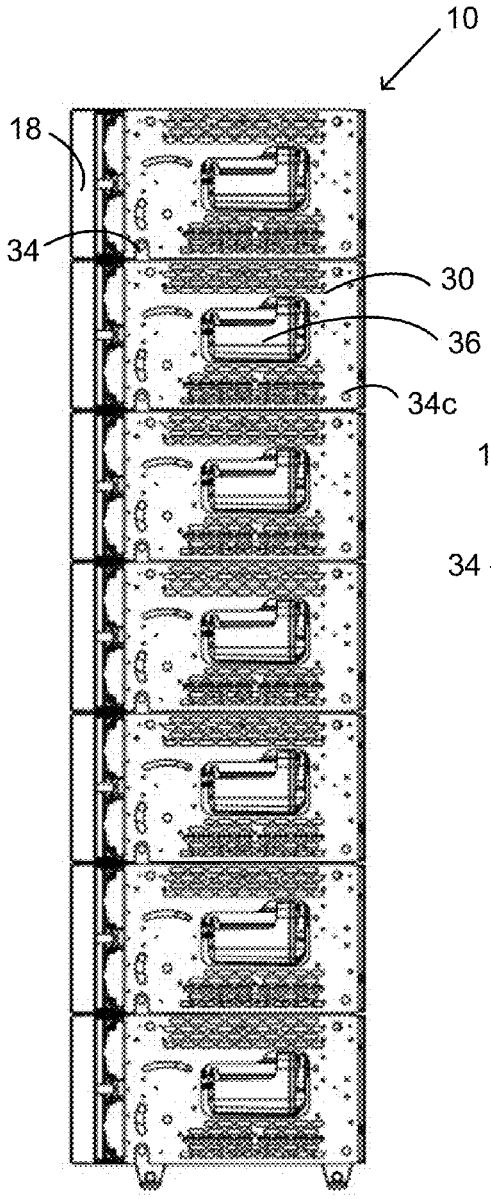
FIG. 16A is a side view of the line array speaker system of FIG. 14.
Figure 16B:
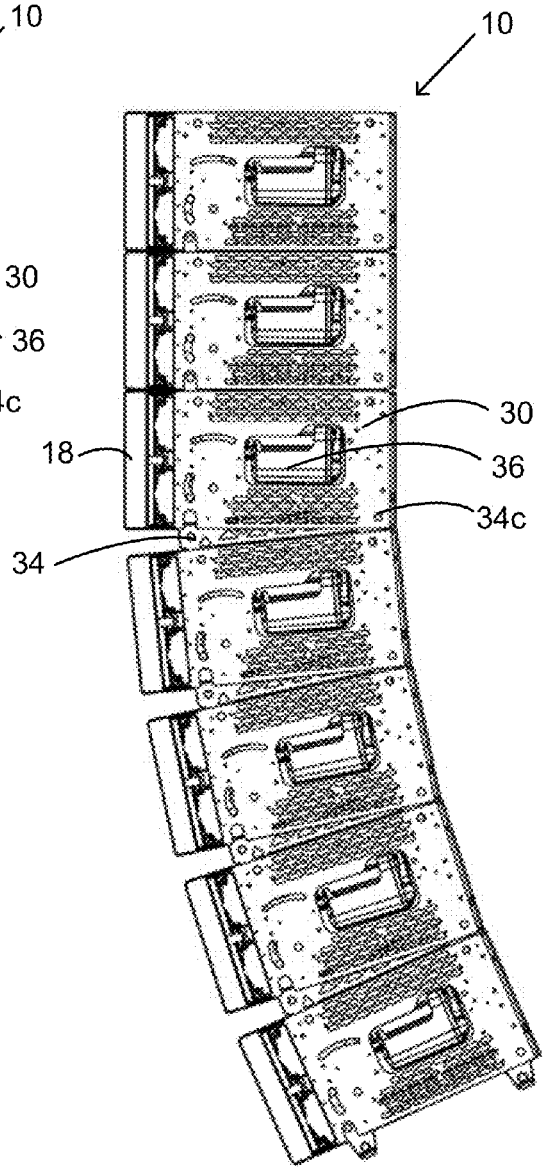
FIG. 16B is a side view of the line array speaker system of FIG. 15.

Referring to FIGS. 7A, 7B, 8, 17A, 17B and 18, each speaker cabinet has a connection system 30 for connecting vertically adjacent speaker cabinets 12 to form the line array speaker system 10, as shown in FIGS. 1, 2A, 2B, 14 and 16A wherein by way of example eight speaker cabinets are connected. The connection system allows the cabinets to pivot with respect to each other to create a curved line array, such as the one shown in FIGS. 3, 15 and 16B. There is a fulcrum or pivot point 34*c* about which vertically adjacent speaker cabinets pivot with respect to one another. In the context of this description, the term "vertical" is meant to refer to a general up and down direction and to include components that may be horizontally offset with respect to one another. That is, adjacent speaker cabinets as depicted in FIGS. 3, 15 and 16B are considered vertical with respect to one another when in a curved line array.

Each connection system 30 includes a lever or hinging member 34 for pivoting the speaker cabinet about the pivot point, and anactuator 36, preferably a linear actuator, for moving or pivoting the lever by applying a force to the lever. The lever has a first end 34*b* that is connected, directly or indirectly, to the actuator 36, preferably by a pivoting connection, for receiving a force from the actuator, and a second end 34*a* that is pivotably connected to the enclosure at or near the rear end. The lever is movable between a neutral position, shown in FIGS. 7A, 17A, 17B and an angled position, shown in FIGS. 7B, 17C and 17D. In the neutral position, the lever is in a generally horizontal position and the actuator is in a retracted position, causing adjacent speaker cabinets to be positioned in the same vertical plane, such as in the line array of speakers shown in FIGS. 1 and 14. In the angled position (FIGS. 7B, 17C, 17D), the actuator is extended to pivot the lever about the pivot point 34*c* to change the angle of adjacent speaker cabinets in a line array to form a curved line array, such as that shown in FIGS. 4B and 15. The actuator can be positioned at any point between extension and retraction to orient the lever at the desired angle with respect to the speaker cabinet.

In one embodiment, the lever is moveable between 0° and 10°. More specifically, the lever is moveable between 0° and 7°. Preferably the actuator is an electromechanical actuator and includes the necessary connection and activation components as would be known to one skilled in the art. The connection mechanism 30 includes various components for connecting the connection mechanism to the enclosure 14 of the speaker cabinet 12, and to connect adjacent speaker cabinets to each other, such as in a line array of speaker cabinets shown in FIG. 1.

In one embodiment, the connection mechanism comprises two substantially parallel vertical attachment walls: an inner attachment wall 32*a* and an outer attachment wall 32*b*. The inner attachment wall generally lies flat against and is connected to the enclosure sidewall 14*d*. The outer attachment wall is spaced apart from the inner attachment wall and connected to the inner attachment wall and/or the enclosure sidewall. Preferably, the actuator 36 and lever 34 are positioned between the inner and outer attachment walls. The components of the connector mechanism include various connecting means for attaching the parts together. The connecting means may include apertures through which fastening means such as pins or screws can be inserted. In the specific example shown in FIG. 5A, the inner and outer attachment walls 32*a,b* have top apertures 32*c* near the top of the speaker cabinet, and the lever has bottom apertures 34*d* near the bottom of the speaker cabinet. The bottom apertures 34*d* of a speaker cabinet are lined up with the top apertures 32*c* of a vertically adjacent speaker cabinet below and the cabinets are connected using suitable fastening means, such as pins or screws. Other suitable means for fastening adjacent speaker cabinets together could be used.

Figure 7A:
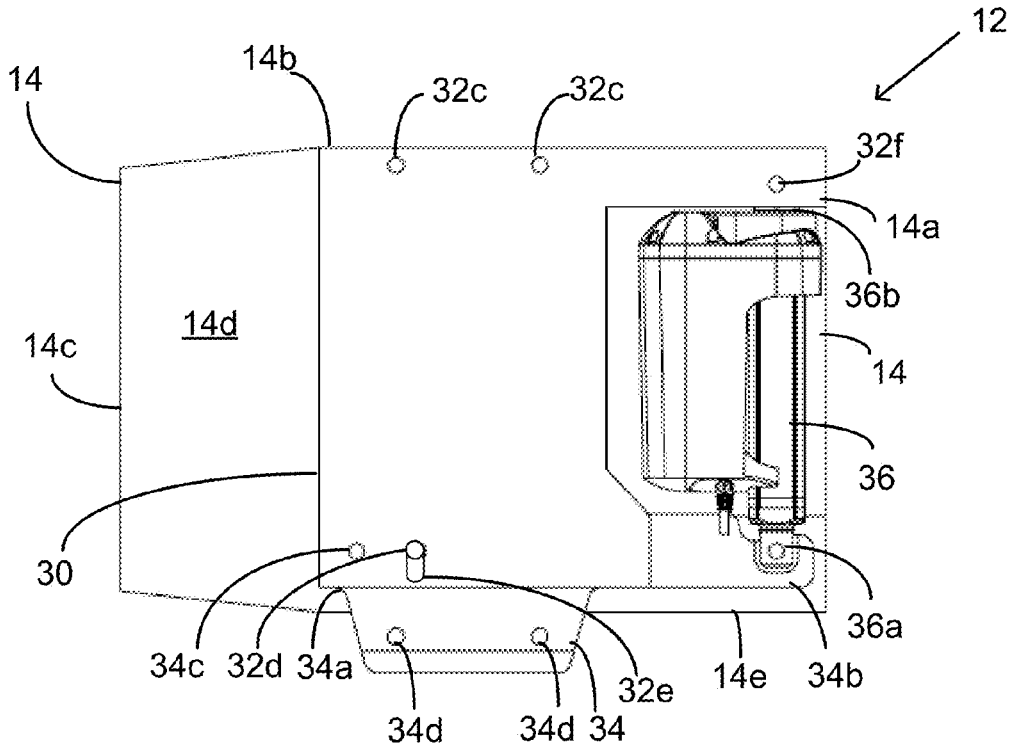
FIG. 7A is a side view of a speaker cabinet with a vertical linear actuator in a retracted position in accordance with one embodiment of the invention.
Figure 7B:
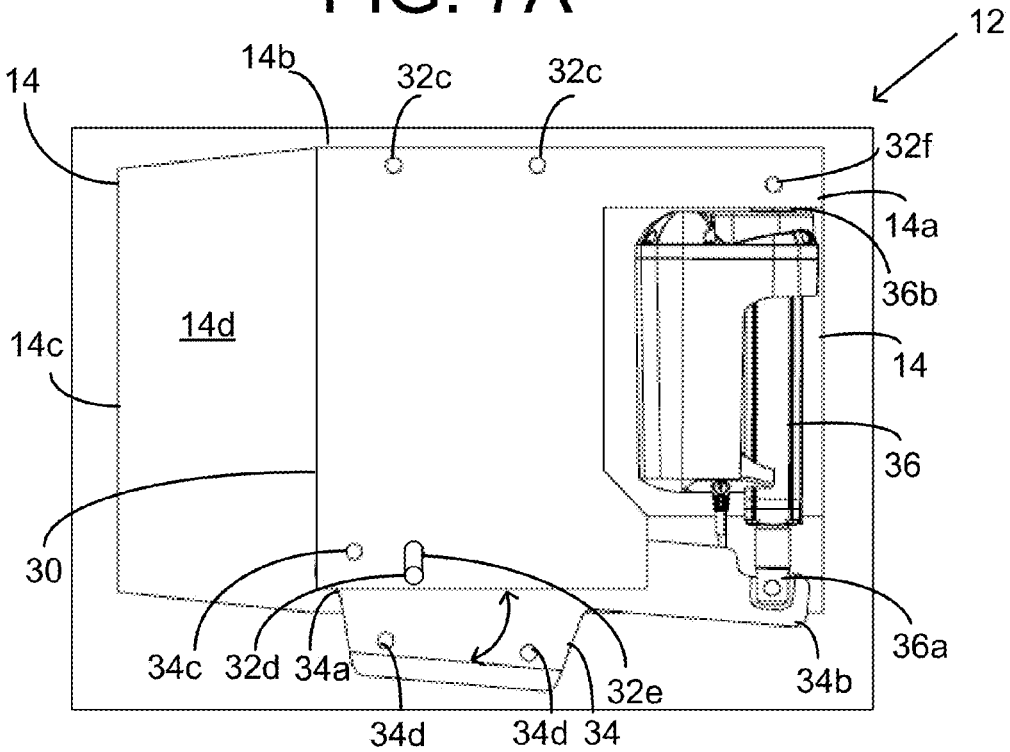
FIG. 7B is a side view of a speaker cabinet with the vertical linear actuator in an extended position in accordance with one embodiment of the invention.
Figure 8:
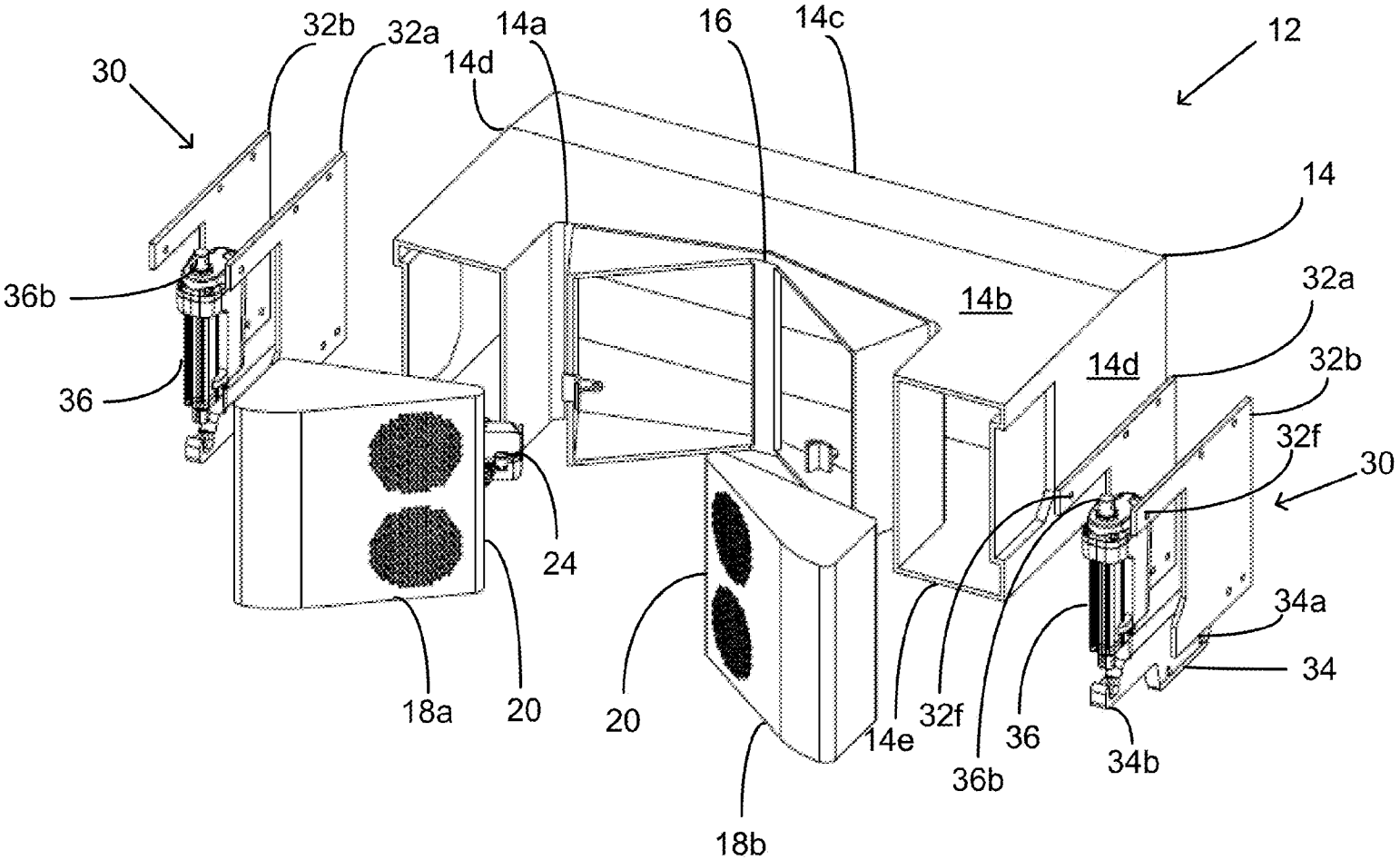
FIG. 8 is an exploded view of a speaker cabinet in accordance with one embodiment of the invention.

In one embodiment shown in FIGS. 1 to 8, the actuator 30 is a linear actuator that is positioned substantially perpendicular to the lever 34 when the lever is in the neutral position, shown in FIG. 7A. In the illustrated example, the linear actuator is substantially vertical with respect to the enclosure 14. In the example shown, the linear actuator has a first end 36*a* that is directly connected to the first end 34*b* of the lever 34, such that linear movement of the actuator, i.e. extension and retraction, causes the lever 34 to pivot about the pivot point 34*c* (i.e. a horizontal axis) between the neutral and the angled position. A second end 36*b* of the actuator is fastened to the enclosure 14, directly or indirectly, with appropriate fastening means. The actuator second end may be fastened to the sidewall of the enclosure. Preferably, a screw or pin is placed through an aperture 32*f*, connecting the inner attachment wall 32*a*, the outer attachment wall 32*b* and the actuator second end 36*b* to the enclosure sidewall 14*d*.

In another embodiment, shown in FIGS. 14 to 18, the actuator 30 is connected to the lever first end 34*b* via at least one linking member or coupler 38 at or near the front side 14*a* of the enclosure. The linking member may act as a further lever, which allows the load from the speaker cabinet(s) to be further reduced on the actuator by providing a further mechanical advantage and otherwise reduce load on the actuator. When the actuator is connected to the lever in this manner, the actuator does not need to be positioned vertically but can be positioned at an angle or in a horizontal position. The movement of the actuator, e.g. linear movement via retraction and extension of the actuator, is transmitted through the one or more linking members in an arcuate fashion to pivot the lever 34 about the pivot point 34*c*. As above, the pivot point 34*c* of the first lever is located at or near the rear side 14*c* of the enclosure.

In the illustrated example in FIGS. 17A-17D, there is a linking member 40 and a second lever 42 that connect the actuator 36 to the (first) lever 34. The second lever 42 includes a second pivot point or fulcrum 42*a* where the second lever is connected to the enclosure, and about which the second lever can pivot. The second lever also includes a first end 42*b* pivotably connected to the actuator 36, and a second end 42*c* pivotably connected to the linking member 40. The linking member 40 has a first end 40*a* pivotably connected to the first lever 34 and a second end 40*b* pivotably connected to the second lever 42.

Figure 17C:
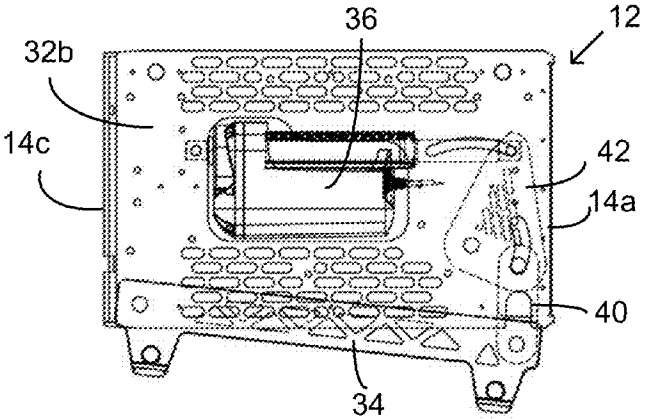
FIG. 17C is a side view of the speaker cabinet of FIG. 17A with the horizontally positioned actuator in an extended position.
Figure 17D:
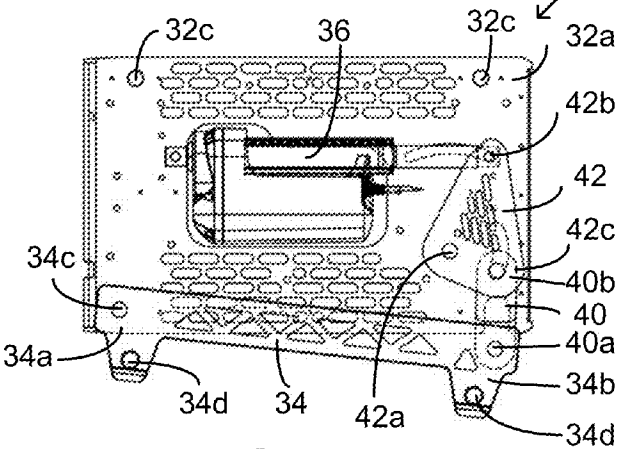
FIG. 17D is a side view of the speaker cabinet of FIG. 17C with the outer attachment wall removed.
Figure 17A:
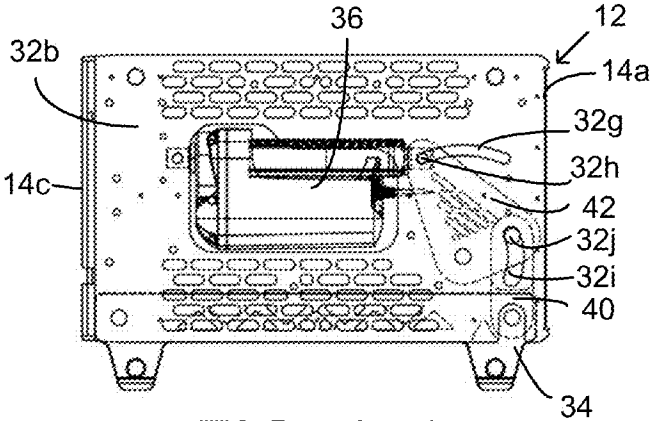
FIG. 17A is a side view of one speaker cabinet from the line array speaker system of FIG. 14 with a horizontally positioned linear actuator in a retracted position in accordance with a second embodiment of the invention.
Figure 17B:
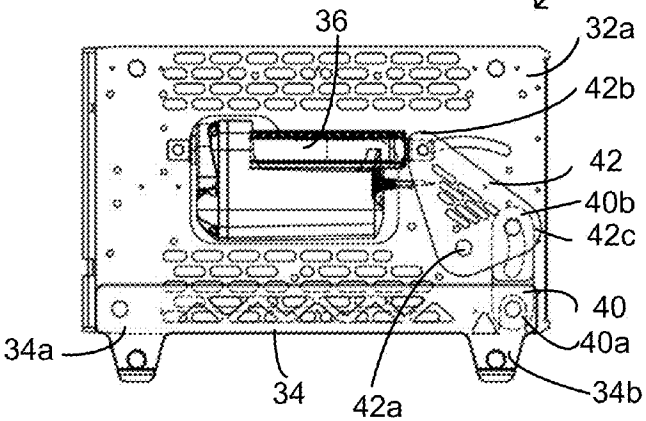
FIG. 17B is a side view of the speaker cabinet of FIG. 17A with the outer attachment wall removed.
Figure 18:
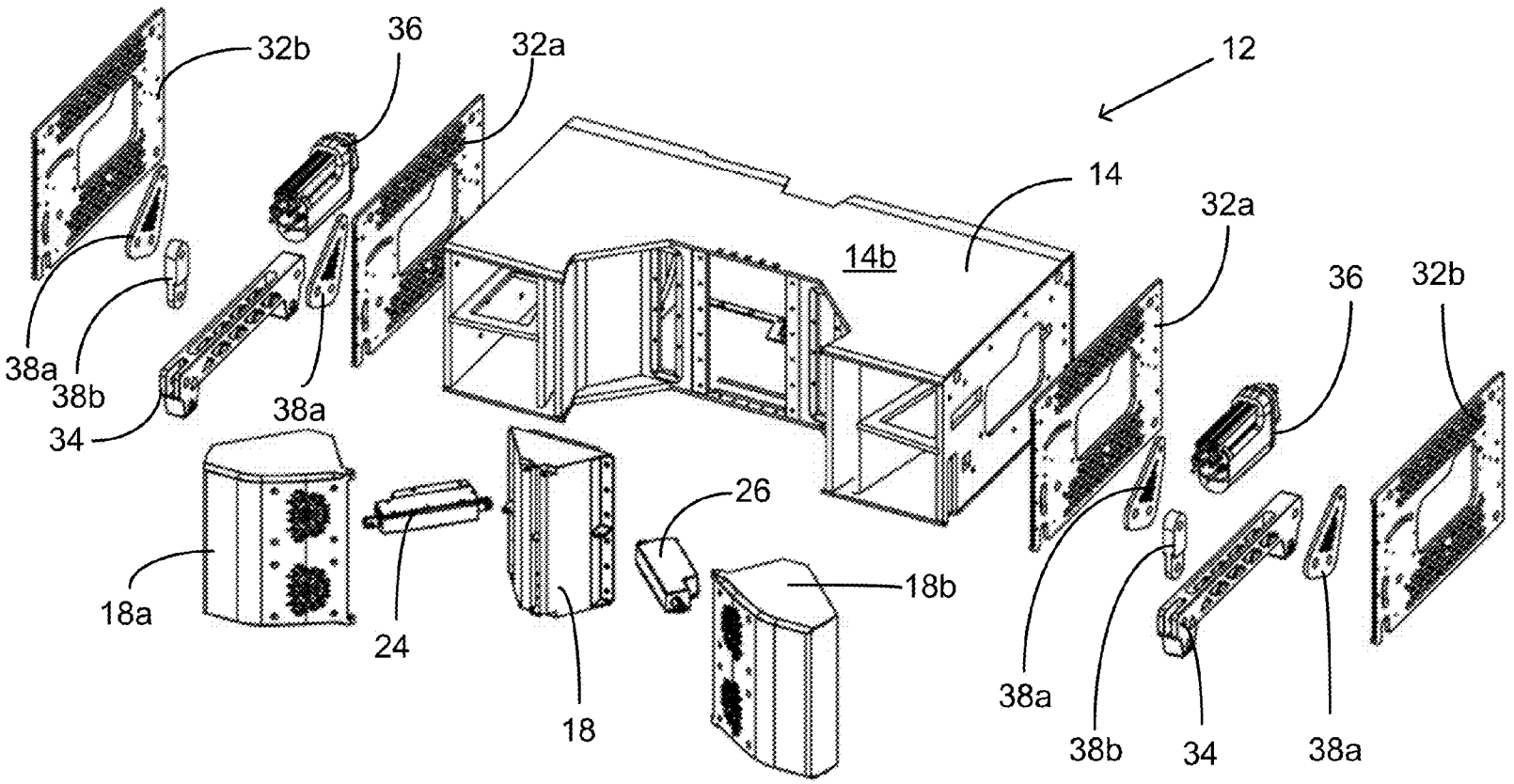
FIG. 18 is an exploded view of the speaker cabinet of FIGS. 17A to 17D.

When the actuator extends, i.e. moves from the position of FIGS. 17A and 17B to the position of FIGS. 17C and 17D, it causes the second lever 42 to pivot about the second pivot point/fulcrum 42*a* and move in an arcuate path, thereby moving the linking member 40 downwards, which causes the first lever 34 to pivot about the pivot point 34*c* from the neutral position to the angled position. Retraction of the actuator reverses this movement. During extension and retraction of the actuator, the first and second ends 42*b*, 42*c* of the second lever move in an arcuate path, illustrated, respectively, by the first and second curved slots 32*g*, 32*i* in the inner and outer attachment walls 32*a*, 32*b* that guide the movement of the second lever via a first and second guide pin 32*h*, 32*j*.

Location of the Elements of the Speaker Connection Mechanism

Preferably, the pivot point 34*c* about which the lever pivots is located near or to the rear of the center of gravity of the speaker cabinet 12 along the sidewall 14*d*. The center of gravity of a speaker cabinet is generally around the mid-point along the sidewall, however in some embodiments the center of gravity may be located to the rear or front of the mid-point of the sidewall. The lever second end 34*a* is located towards the front side of the speaker cabinet with respect to the pivot point, and preferably the lever second end is in front of the center of gravity of the enclosure. Positioning the pivot point to the rear of the lever second end reduces the load on the actuator 36 when the speaker system is suspended. The reduced load on the actuator allows the actuator to be activated even while the speaker system is in a hanging position to adjust the angle between adjacent cabinets. The reduced load on the actuator also allows for a more economical and/or compact actuator to be used as it does not need to have as large of a maximum load limit. Furthermore, as the actuator is typically the weakest link in speaker system, reducing the load on the actuator provides for increased safety of the system.

Preferably, the pivot point is located along the rear half of the sidewall. In one embodiment, the pivot point is located substantially at or near the rear end of the cabinet sidewall.

In another embodiment, the pivot point is located approximately halfway between the center of gravity of the speaker and the rear end of the cabinet sidewall. In other words, if the center of gravity is located at the mid-point of the sidewall, the pivot point would be ¼ of the entire sidewall distance from the rear of the cabinet.

In a further embodiment, the pivot point is located approximately ⅔ of the distance from the rear end of the cabinet sidewall to the center of gravity of the speaker. In other words, if the center of gravity is located at the mid-point of the sidewall, the pivot point would be ⅓ of the entire sidewall distance from the rear of the cabinet.

Figures 19A, 19B, 19C:
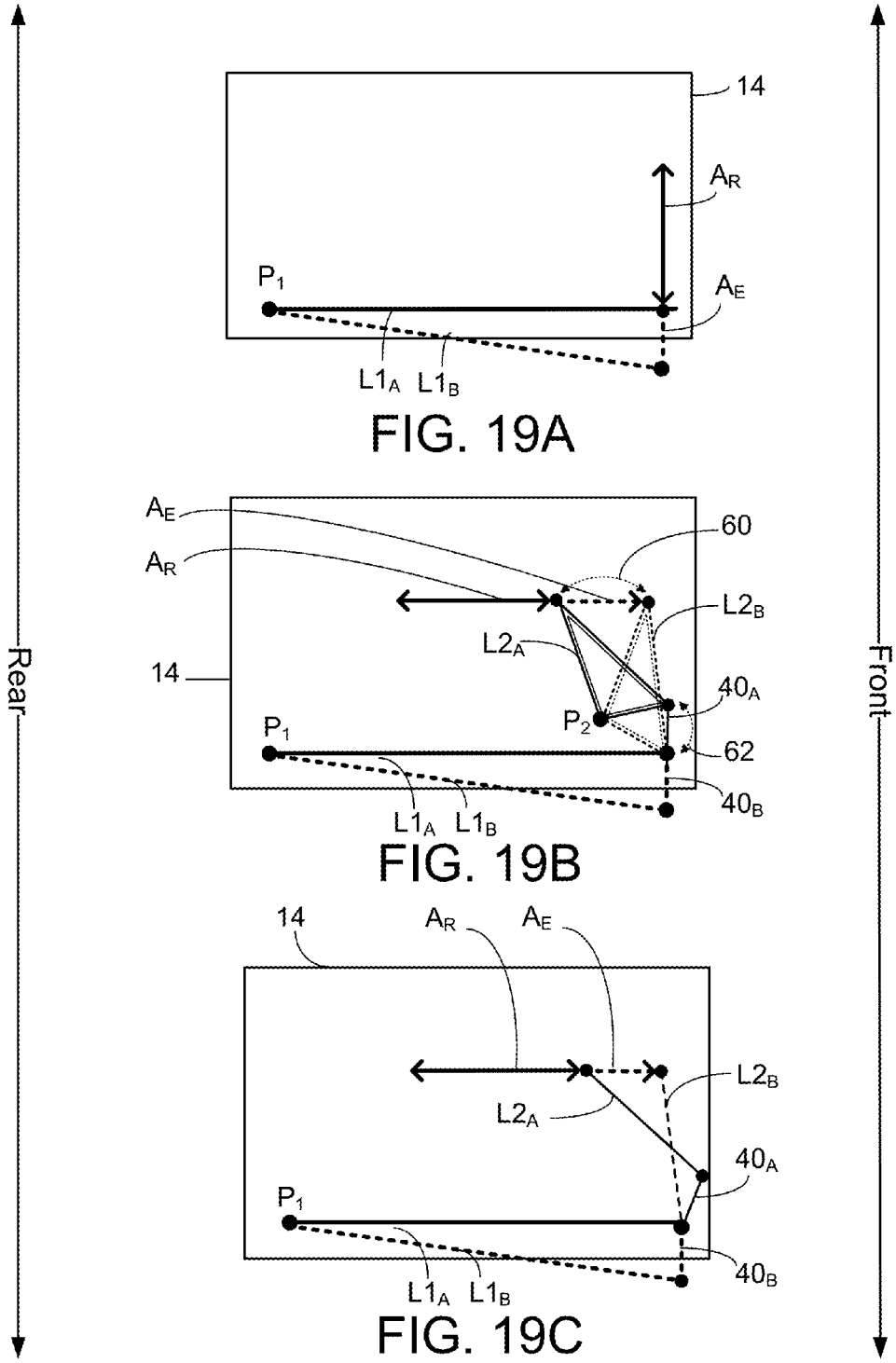
FIG. 19A is a schematic side view of the speaker cabinet illustrating a connection system having one lever and a vertical actuator in accordance with one embodiment of the invention.
FIG. 19B is a schematic side view of the speaker cabinet illustrating a connection system having two levers, one of the levers being a triangular shaped lever, and a horizontal actuator in accordance with one embodiment of the invention.
FIG. 19C is a schematic side view of the speaker cabinet illustrating a connection system having two straight levers and a horizontal actuator in accordance with one embodiment of the invention.

FIGS. 19A-19C illustrate the sidewall of the enclosure, showing possible configurations for the speaker connection mechanism. In FIG. 19A, there is one lever L1 that is pivotable about pivot point $P_1$ located adjacent the rear of the enclosure 14, the lever pivotable between the neutral position $L1_A$ shown by the solid line, and the angled position $L1_B$ shown by the broken line. The actuator A is positioned substantially perpendicular to the lever in the neutral position and connects to the lever substantially adjacent the front of the speaker. The actuator is movable between the retracted position $A_R$ shown by the solid line, and the extended position $A_E$ shown by the dotted line, to move the lever between the neutral position and angled position, and to any position between the neutral and angled position. This configuration is illustrative of the embodiment shown in FIGS. 1-8.

FIG. 19B illustrates the embodiment of the invention shown in FIGS. 14-18, wherein the actuator A is connected to the first lever L1 by a second lever L2, which is generally triangular shaped and shown by the double line, and a linking member 40. That is, the fulcrum $P_2$ is offset with respect to the ends of L2. Movement of the actuator from the retracted position $A_R$ to the extended position $A_E$ causes the second lever to pivot about a second pivot point $P_2$ from the position $L2_A$ shown by the double solid line, to a position $L2_B$ shown by the double broken line. This moves the linking member 40 downwards from position $40_A$ shown by the solid line, to position $40_B$ shown by the broken line, which then pivots the first lever from the neutral position $L1_A$ to the angled position $L1_B$. In this embodiment, the triangular shape of the second lever causes the first and second ends 42*b*, 42*c* of the second lever to move in generally arcuate paths shown by the dotted arrows 60 and 62 when the lever pivots, and the linking member 40 to move in a generally straight vertical path between the extended and neutral positions.

FIG. 19C illustrates an alternative embodiment of the invention wherein there is a second lever L2 and a linking member 40 connecting the actuator A to the first lever L1, however the second lever does not pivot per se about a fixed fulcrum. In this embodiment, the second lever moves in a linear or arcuate fashion between position $L2_A$ and $L2_B$, causing the linking member to move from position $40_A$ to $40_B$ to move the first lever from the neutral position $L1_A$ to the angled position $L1_B$. In this case, the respective ends of the L2 (or other positions of L2) may move within defined linear or arcuate channels that facilitate movement of L2 to move the first lever L1 between the neutral and angled positions. In addition, L2 may be non-linear.

Although the invention has been described and illustrated with reference to specific examples of the speaker connection system, other embodiments using any number of levers and linking members to connect the actuator to the first lever could be used that would be within the scope of the invention.

Stopping Devices of the Speaker Connection Mechanism

Various stopping devices such as guide pins and slots may be used to guide and/or limit the movement of the moving parts of the connection mechanism 30. In the example shown in FIGS. 7A and 7B, the connection mechanism comprises a guide pin 32*d* in a slot 32*e*, wherein the guide pin connects the attachment walls 32*a*, 32*b* to the lever 34 and the enclosure sidewall 14*d*. The guide pin is moveable within the slot as the lever pivots with respect to the attachment walls. The lever contains a corresponding slot lined up with slot such that the lever can move with respect to the attachment walls. The guide pin acts as a motion limiting device to prevent the angle of the lever, and hence the angle between vertically adjacent speaker cabinets, from exceeding the maximum angle limit. This is important for preventing adjacent speaker cabinets from exceeding the angle limit and/or detaching in the unlikely event of complete actuator failure, thereby providing a back-up safety mechanism.

Movement of a Vertical Array of Speakers

When speaker cabinets are connected in a vertical line, pivoting the levers on both sides on an upper speaker cabinet causes the entire speaker cabinet below to pivot on a vertical plane with respect to the upper speaker. Preferably there is a control device that controls the actuators on either side of a speaker cabinet to retract or extend at the same speed and time (i.e. rate) in order to pivot both levers substantially simultaneously to avoid unnecessary strain on the speaker cabinet connection mechanisms 30. In one embodiment, both actuators on the speaker cabinet are controlled by one motor control circuit.

FIGS. 1, 2A, 2B, 14 and 16A show a line array system wherein the angle between all adjacent speaker cabinets is 0° to create a straight line array. In contrast, FIGS. 3, 4A, 4B, 15 and 16B illustrate a line array speaker system wherein the inter-cabinet angle θ between adjacent speaker cabinets has been adjusted to create a common curved shape of a line array speaker system. In this embodiment, the first two inter-cabinet angles $\theta_1$ and $\theta_2$ are 0°, and the next 5 inter-cabinet angles $\theta_3$, $\theta_4$, $\theta_5$, $\theta_6$, and $\theta_7$ are approximately 5°. The total curvature of the line array is the summation of all the inter-cabinet angles. In this case, the total curvature for the line array shown in FIG. 4B would be approximately 25°.

Figure 4B:
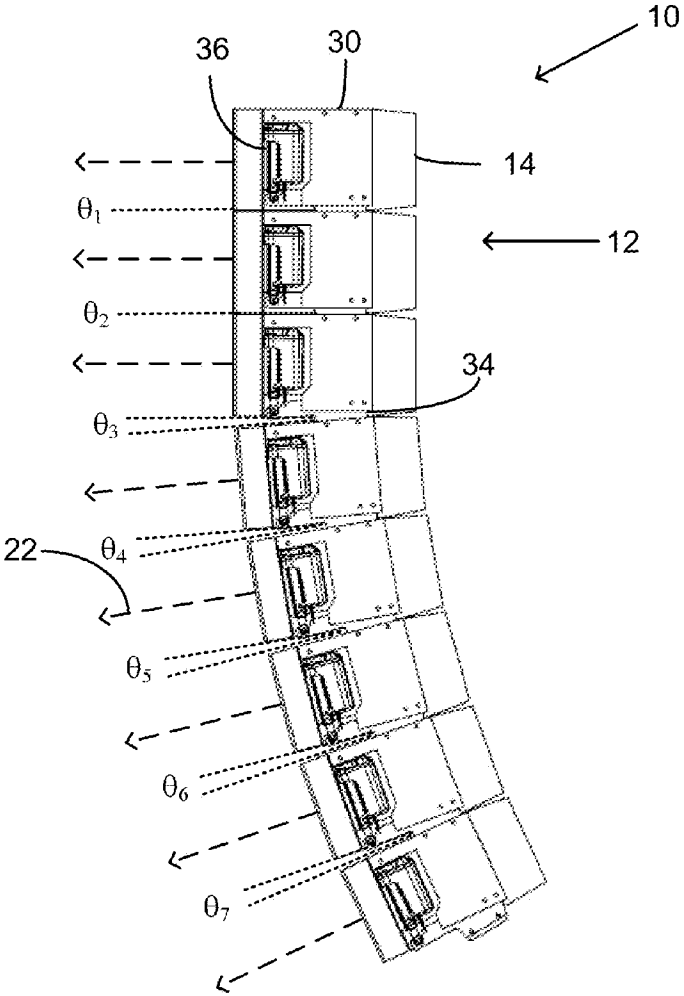
FIG. 4B is a side view of a line array speaker system in a curved position with the waveguide walls progressively moving from an open position to an inward position in accordance with one embodiment of the invention.

Adjusting the vertical angle between adjacent speaker cabinets changes the vertical angle of the sound dispersion field being emitted from the line array speaker system. FIG. 2B shows the vertical plane of the sound dispersion field 22 when the speaker system is configured in a straight line, compared to FIG. 4B showing the sound dispersion field 22 when the speaker system is configured in a curved line.

Setting Up the Speaker System

To set up the speaker system, a plurality of speaker cabinets are connected in a vertical line array while on the floor at a venue or prior to arriving at the venue. A desired number of speaker cabinets can be connected in the line array which depending on the size of the venue will typically be 3-15 speakers, and may be up to 24 or more speakers. Preferably, individual speakers are stacked and interconnected with respect to one another to form a vertical stack such that the angle between adjacent speaker cabinets is 0° as shown in FIGS. 1, 2A, 2B, 14 and 16A. The waveguide walls 18*a*, 18*b* can be in any position, however orienting all the waveguide walls in the open position to start is preferable.

The line array speaker system 10 is suspended from the ceiling of the venue via known rigging mechanisms (not shown). Preferably, a lifting frame, typically made of steel, is attached to the top of the line array speaker system. Mechanical hoisting devices such as electric chain motors or winches are connected to the lifting frame and the speaker system for hoisting and suspending the speaker system. The speaker system may be suspended by a flybar that can be adjusted to change the vertical angle of the whole line array speaker system. For example, the flybar may be adjusted at an angle of −5° to direct the line array slightly downwards, thereby projecting the sound from the line array speaker system slightly downwards to an audience below even if the angle between adjacent speaker cabinets is 0°. After installation, the angle θ between each speaker cabinet is adjusted to modify the sound array field on a vertical plane, and the angle of each waveguide wall is adjusted to modify the sound array field on a horizontal plane, allowing for 3-dimensional adjustment of the sound array field to best suit the venue and audience.

Figure 4A:
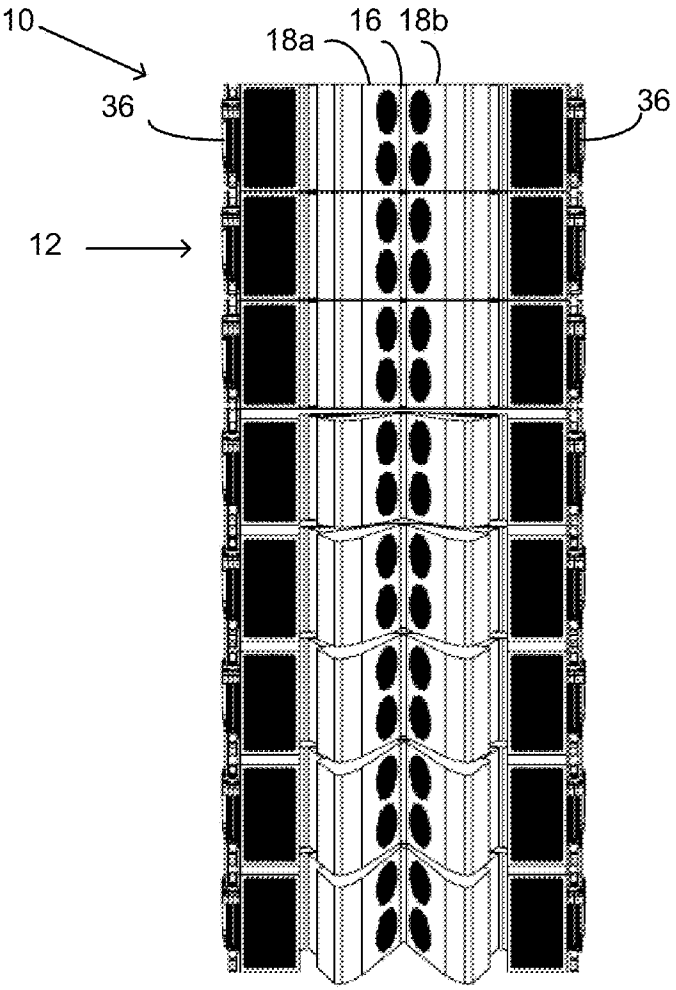
FIG. 4A is a front view of a line array speaker system in a curved position with the waveguide walls progressively moving from an open position to an inward position in accordance with one embodiment of the invention.

In a typical venue, shown in FIGS. 3, 4A and 4B, the angles between the speaker cabinets are adjusted to form a curved line array to progressively project the sound dispersion field 22 downwardly from the top of the array to the bottom. The configuration and angle of the curve will depend on the venue. The line array may also be positioned in a straight line array for certain venues, wherein the flybar is adjusted to direct the entire straight line array at a slight downward angle, such as 5° and up to 10°.

FIG. 4B illustrates a curved line array having a maximum curvature of approximately 25°, which is the summation of all the inter-cabinet angles θ. In other embodiments, the total curvature may be less or more than 30°. Typically, the total curvature would be adjusted to 60° or less. In general, the greater the number of cabinets in the line array, the greater the total possible curvature. While greater total curvatures than 60° may be possible, a total curvature of greater than 60° would not typically be used in a conventional venue.

In a typical venue wherein the line array is adjusted to form a vertical curve, the waveguide walls 18*a*, 18*b* would be angled progressively inwards from the top to the bottom of the array, causing the horizontal sound dispersion field to narrow from top to bottom, as illustrated in FIG. 4A.

Automated Adjustment

Figure 11:
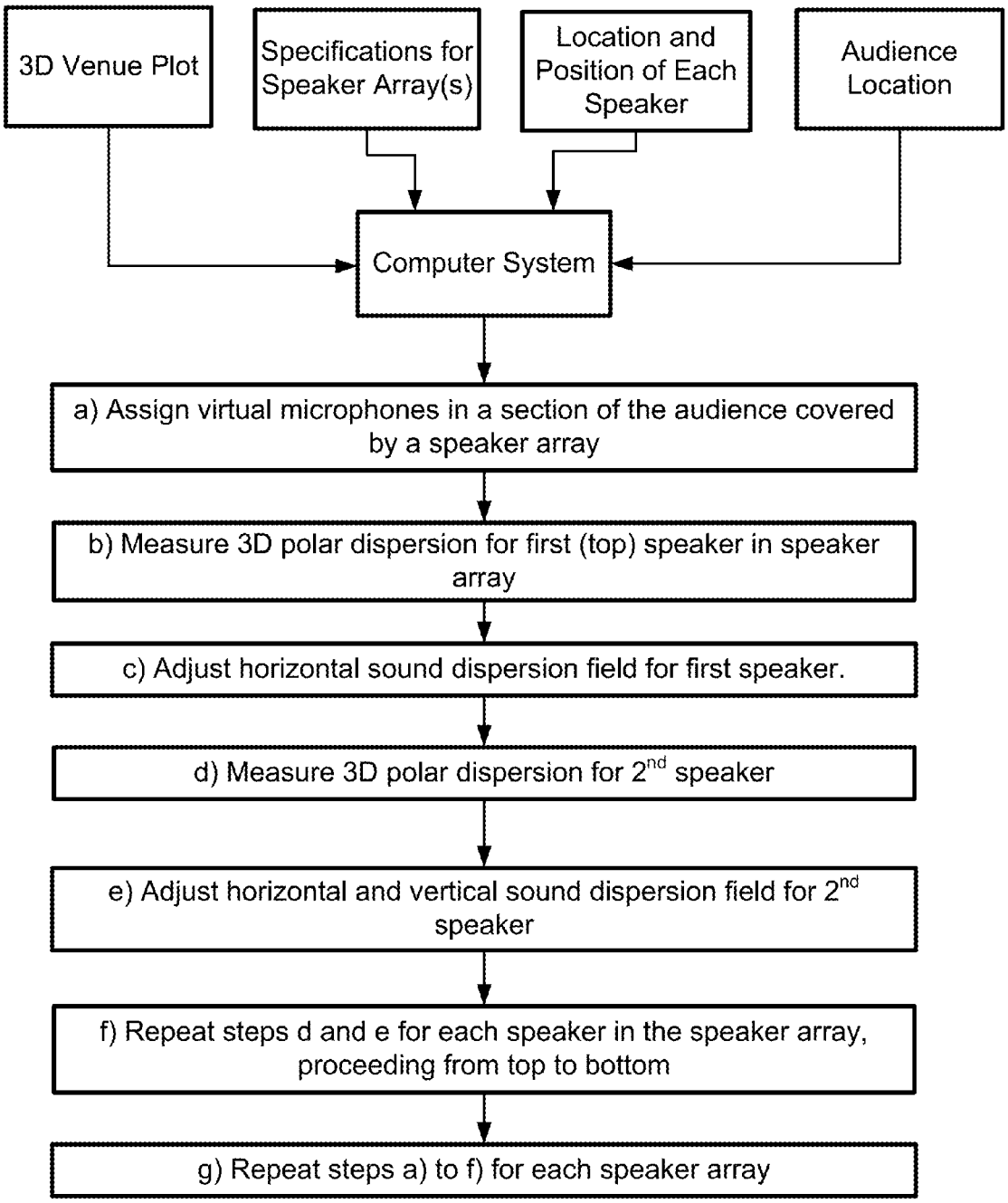
FIG. 11 is a flowchart showing the automatic adjustment system of speakers and speaker arrays in accordance with one embodiment of the invention.

In one embodiment, referring to FIG. 11, the 3-dimensional sound dispersion field of a line array of speakers is adjusted using an automated system with minimal human intervention as described below.

At least one speaker array having a plurality of speaker cabinets is assembled and suspended in a venue. In the preferred embodiment, the venue has tiered seating, however the venue may have alternative forms of seating arrangements. A 3-dimensional plot of the venue space as well as the location and specifications of the speaker array(s) within the venue space is input into a computer system. A user manually enters into the computer system the position of each speaker in the speaker array(s), or the position is automatically calculated by the computer system using the speaker array specifications that were inputted. The user also inputs the location of the audience in the venue, which may vary based on the event that is being held in the venue.

Figure 9:
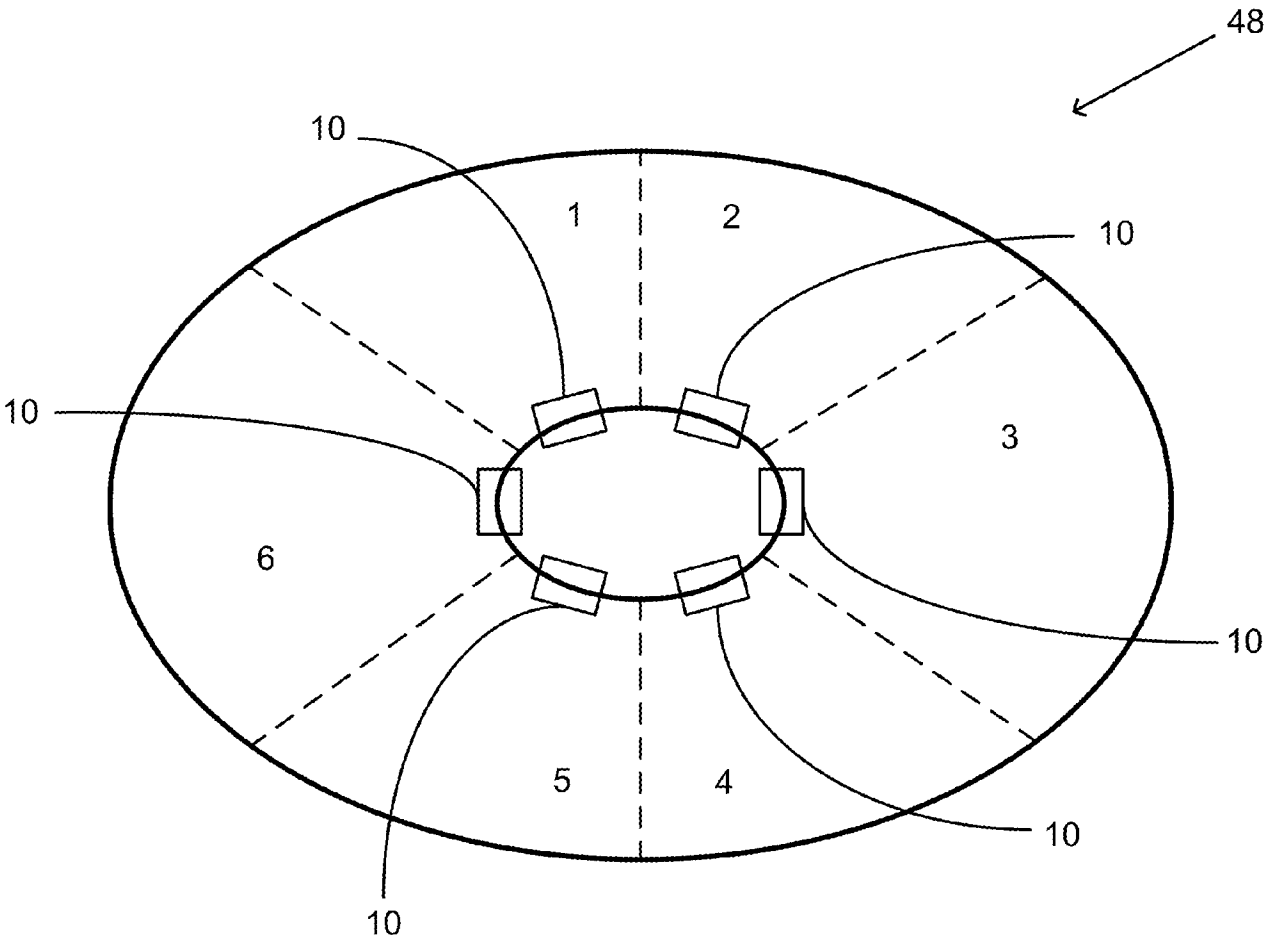
FIG. 9 is a top view of a venue showing audience sections 1-6 and speaker arrays in accordance with one embodiment of the invention.
Figure 10:
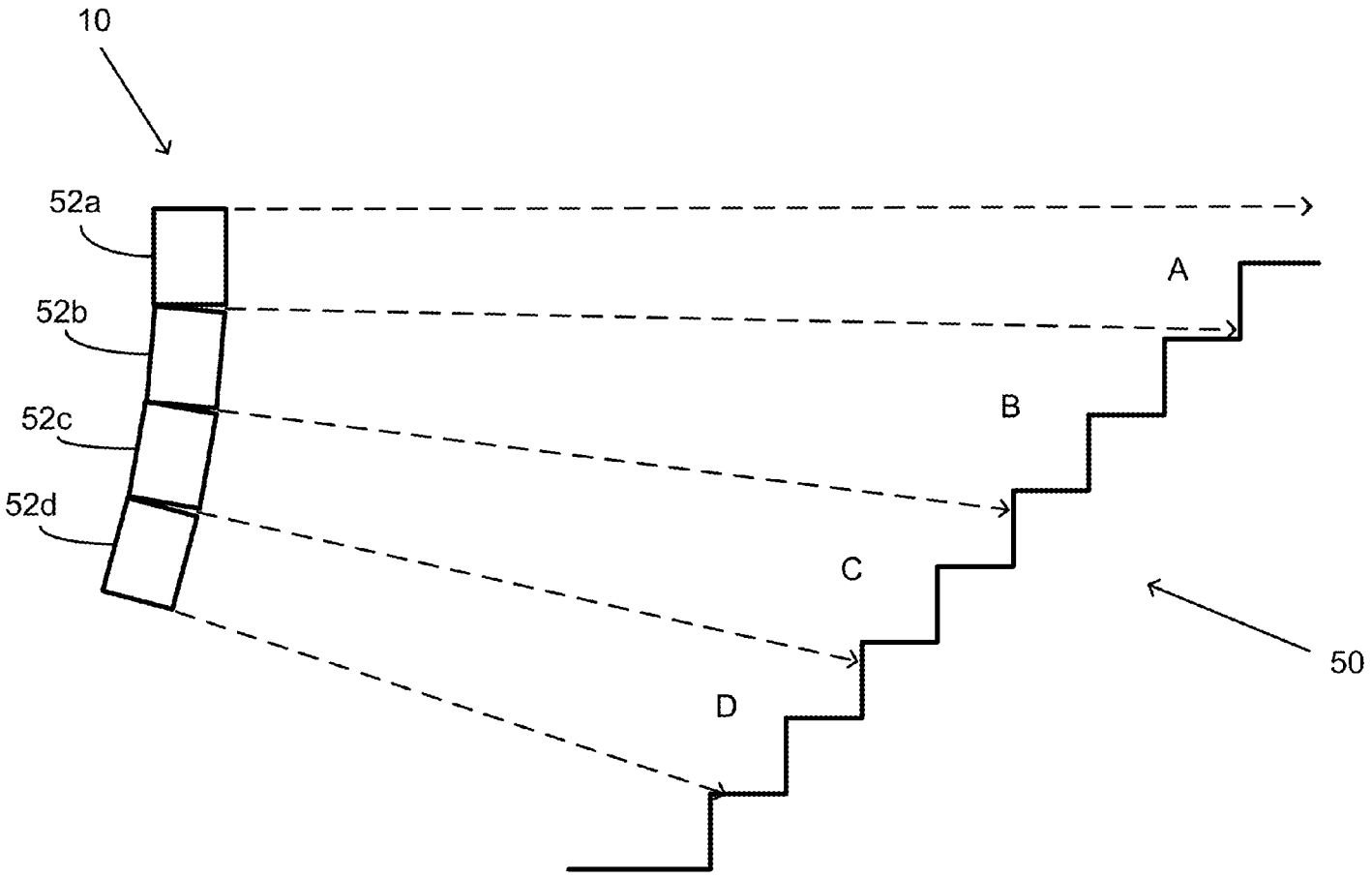
FIG. 10 is a side view of a section of a venue showing tiered seating and a speaker array in accordance with one embodiment of the invention.

The computer system determines an area of the audience that each speaker array is responsible for providing sound to. FIG. 9 illustrates a venue 48 divided into six sections labeled 1 to 6, each section having a speaker array 10 for providing sound to that section. Within a section, there is typically tiered seating 50 for the audience, as shown in FIG. 10. The computer system determines the tiers that each speaker within a speaker array 10 is responsible for providing sound to. For example, FIG. 10 illustrates a speaker array 10 having four individual speakers 52*a*, 52*b*, 52*c* and 52*d*. The tiered seating is divided into four sections, labeled A, B, C, and D, each section corresponding to an individual speaker. The uppermost speaker 52*a* would be responsible for providing sound to the uppermost section of tiers A. The next speaker 52*b* would be responsible for providing sound to the next section of tiers B, and so on.

In a section of the venue 48, such as section 1, the computer system assigns virtual microphones to positions at set intervals across section 1, such as at every square meter. The computer system then measures the 3D polar dispersion of the uppermost speaker 52*a* in the speaker array and automatically adjusts the waveguide of the speaker by activating the waveguide actuators to aim the horizontal sound dispersion area at the optimal angle to provide sound to section 1. For the uppermost speaker 52*a*, the vertical sound dispersion area is set during suspension of the speaker array and adjustment of the flybar such that the uppermost speaker 52*a* projects sound into the uppermost section A of the tiered seating.

Next, the computer system measures the 3D polar dispersion of the second speaker 52*b* in the array using the virtual microphones. The angle of the second speaker 52*b* is adjusted along a vertical plane with respect to the uppermost speaker 52*a* by pivoting the hinging mechanism of the uppermost speaker 52*a*. The angle of the second speaker 52*b* is adjusted by the computer system to optimally direct the vertical sound dispersion area of the second speaker 52*b* into a second section B of tiered seating. The overall angle of the uppermost speaker 52*a* does not move during this adjustment process, only the lever on the uppermost speaker moves, causing the second speaker to move. The computer system also automatically adjusts the waveguide of the second speaker to optimally adjust the horizontal sound dispersion area of the second speaker to cover section 1 of the venue.

The computer system then measures and adjusts the 3D polar dispersion of the next speaker 52*c* in the array in the same manner as the speaker 52*b* above was adjusted. This process is continued for each individual speaker in the speaker array, working from top to bottom. Upon completion of adjusting all the speakers in the array for section 1, the computer system repeats the process for the remaining speaker arrays in the other sections 2-6 until each individual speaker in the venue has been measured and adjusted.

In one embodiment, the angle of each speaker and/or the angle of each waveguide are preliminarily adjusted either before or after suspension of the speaker array but prior to the automatic adjustment by the computer system. The preliminary adjustments may be manually inputted or preset based on known and/or expected angles.

In another embodiment, the angle of the uppermost speaker in a speaker array can be adjusted using the flybar or similar device.

In one embodiment, more than one speaker array can be tested and adjusted simultaneously in order to reduce the time required for adjustments. In another embodiment, the speakers can be tested and adjusted in any order.

In yet another embodiment, the computer system stores the determined optimum angles for a venue. This information can then be re-used to preset the angles next time the speaker system is used in that venue.

The system may also include a manual override.

In another embodiment, the array of speakers is not suspended but is supported by a surface such as the floor, a stage, or a platform.

Load Calculations

Figure 12:
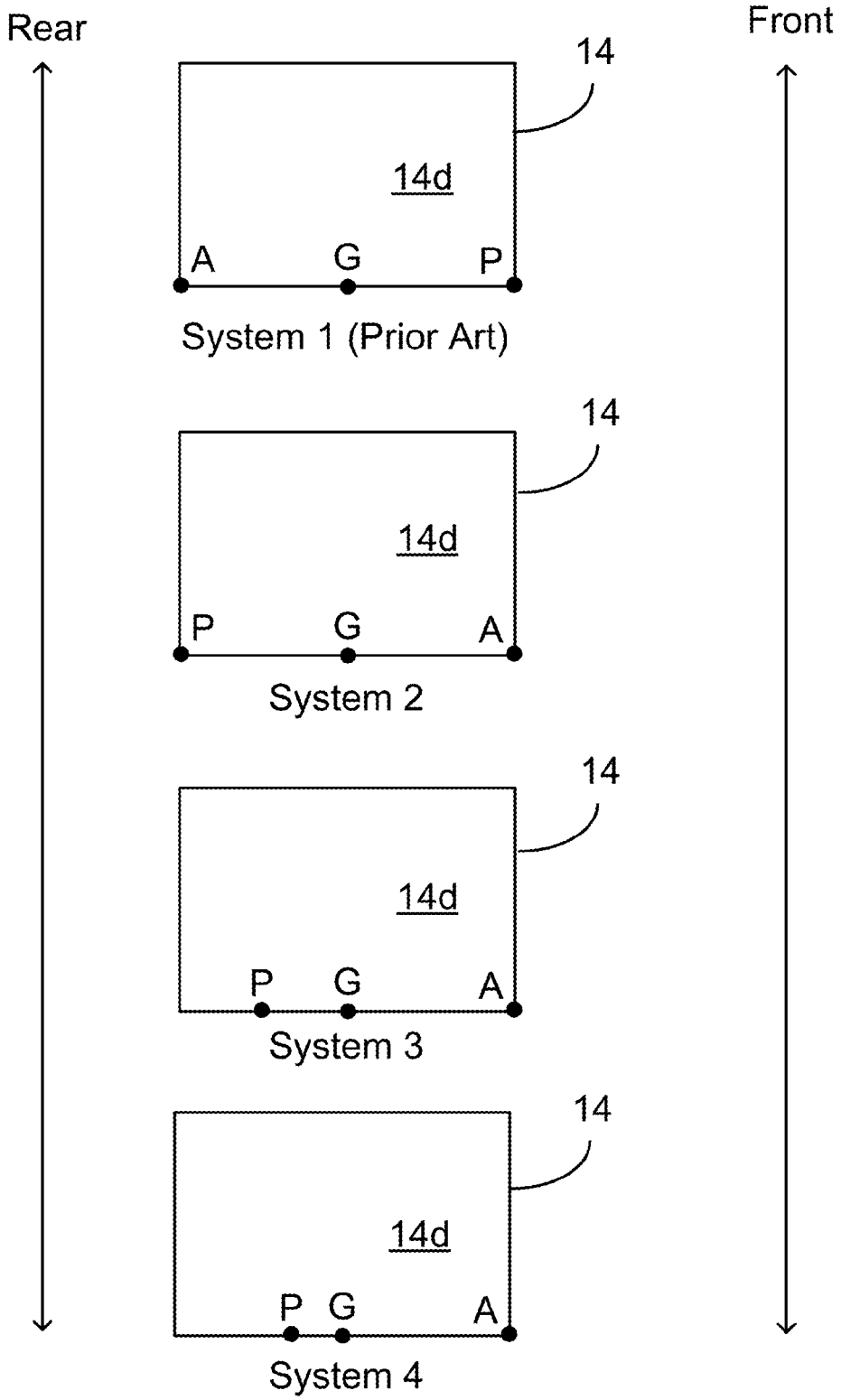
FIG. 12 is a side view of speaker cabinet sidewalls showing various locations of pivot points and actuators for systems for which load calculations were performed.

Load calculations comparing vertical line array speaker systems having connection mechanisms on the sidewalls of the speaker cabinets wherein the pivot points and linear actuators are in various locations, as shown in Table 1, are provided. FIG. 12 illustrates the location of the pivot points (P) and actuators (A) along the sidewall 14*d* for each system 1-4. The center of gravity (G) is located at the mid-point of the sidewall.

TABLE 1

Location of linear actuator and pivot point along speaker cabinet sidewall for various speaker systems.

| | Speaker System 1 (Prior Art) | Speaker System 2 | Speaker System 3 | Speaker System 4 |
|---|---|---|---|---|
| Location of Actuator along Sidewall | Rear | Front | Front | Front |
| Location of Pivot Point along Sidewall | Front | Rear | ¼ of sidewall distance from the rear | ⅓ of sidewall distance from the rear |

Figure 13:
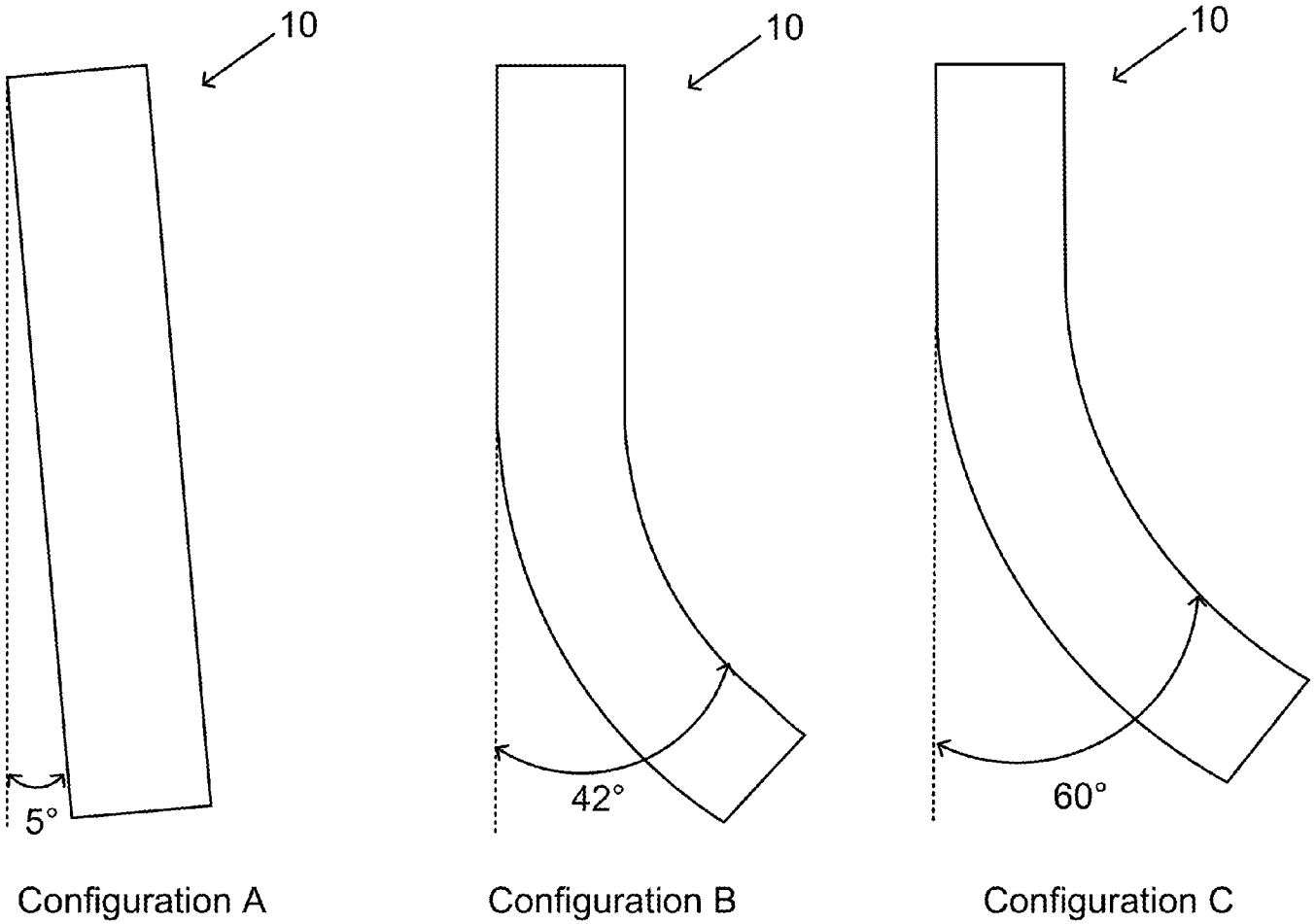
FIG. 13 is a side view of various configurations for speaker line array systems for which load calculations were performed.
Figure 14:
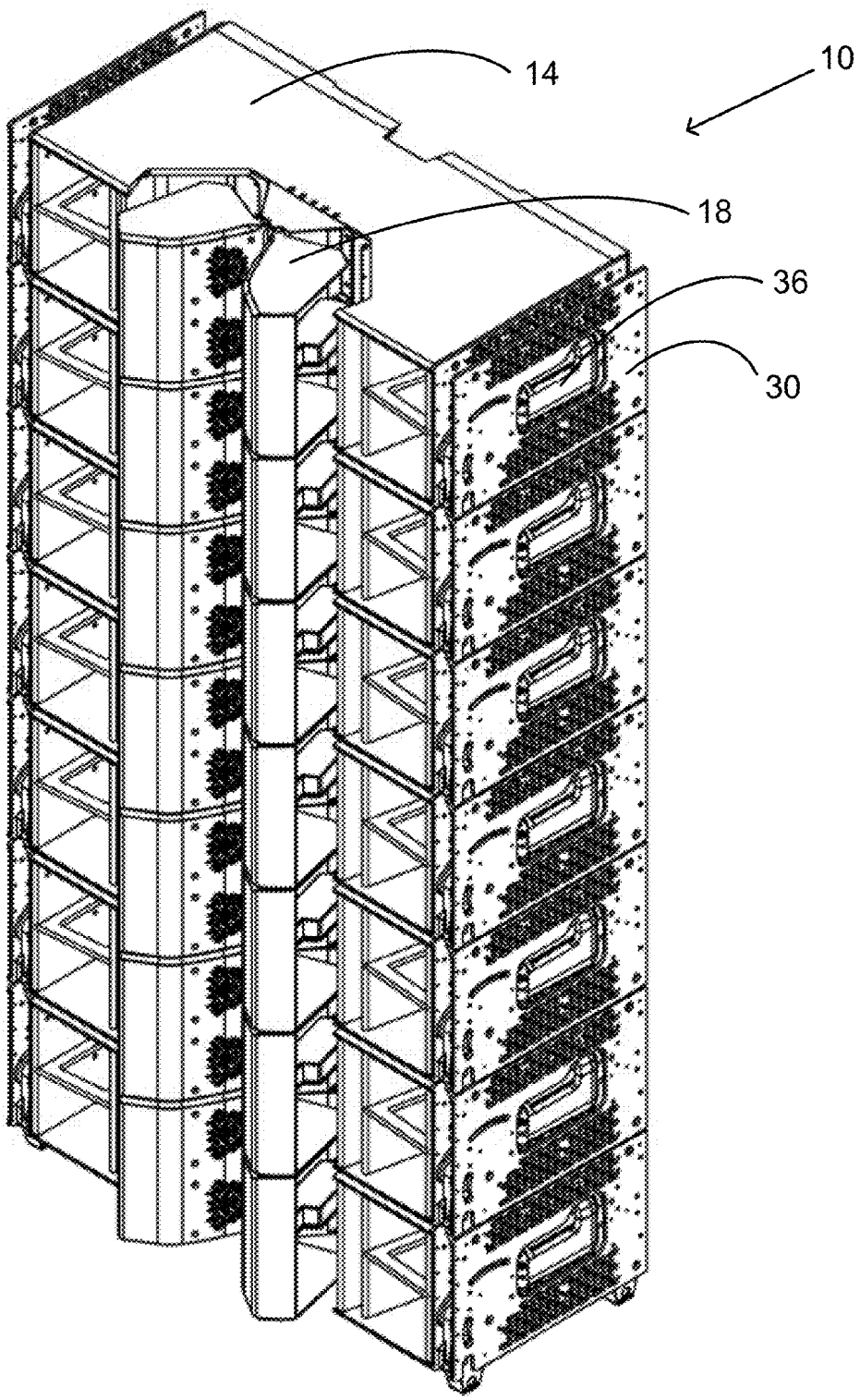
FIG. 14 is a front perspective view of a line array speaker system in a straight position having waveguide walls in an inward position in accordance with a second embodiment of the invention.

The load calculations were performed for a system having 24 loudspeakers weighing 220 lbs (100 kg) each, wherein each loudspeaker had an actuator and pivot point located on each of the two sidewalls. The load on each actuator for each system was calculated for 3 different standard loudspeaker arrangements with varying flybar inclinations and inter-cabinet angles, as shown in Table 2. FIG. 13 illustrates the configurations A, B and C for the line array system 10.

TABLE 2

Fly bar angle and total inter-cabinet angles for various line array configurations.

| | Line Array Configuration A | Line Array Configuration B | Line Array Configuration C |
|---|---|---|---|
| Flybar Angle (°) | −5 | 0 | 0 |
| Total Curvature of Line Array (°) (summation of all inter-cabinet angles) | 0 | 42 | 60 |

Table 3 illustrates the load on each actuator of the upper cabinet of systems 1-4 in the various line array configurations A, B and C.

TABLE 3

Load on Each Actuator for Systems 1-4 in various configurations.

| | Load In Newtons on Each Actuator | | |
|---|---|---|---|
| | Configuration A | Configuration B | Configuration C |
| System 1 (Prior Art) | 12,558 | 8,547 | 11,117 |
| System 2 | 2,171 | 1,594 | 1,586 |
| System 3 | 6,095 | 1,164 | 5,193 |
| System 4 | 8,220 | 2,651 | 7,058 |

As shown in Table 3, the load on the actuator when it as located at the rear of the cabinet sidewall, as per the prior art system 1, was the highest for all three line array configurations. In configuration A (i.e. a straight hanging line array at a −5 degree angle), the load was progressively reduced as the pivot point (P) was moved rearwards in systems 2, 3 and 4.

In configuration B (i.e. a moderately curved line array), the load was considerably reduced in systems 2, 3 and 4 when the pivot point was located to the rear of the actuator, as compared to system 1 with the pivot point located in front of the actuator. In configuration C (i.e. a substantially curved line array), the load was also reduced in systems 2, 3 and 4 as compared to the prior art system 1.

As would be known to one skilled in the art, as the total curvature of a line array increases, there is a certain point wherein the force on the actuator would switch from a tensile force to a compressive force as the load moves rearward with respect to the actuator. This would be the case for certain configurations and systems in the load calculations. Whether the force on the actuator is tensile or compressive, it is indicated as a total load in the load calculations.

The percent reduction in the load on each actuator for each system 2-4 in various line array configurations A, B and C as compared to the prior art system 1 was calculated, as shown in Table 4. As can be seen, there was a reduction in load for each configuration and system as compared to the prior art system.

TABLE 4

Percent Reduction in Load on Each Actuator Compared to the Prior Art (System 1).

| | Percent Reduction In Load on Each Actuator Compared to System 1 (the Prior Art) | | |
|---|---|---|---|
| | Configuration A | Configuration B | Configuration C |
| System 2 | 82.7% | 81.4% | 85.7% |
| System 3 | 51.5% | 86.4% | 53.3% |
| System 4 | 34.5% | 69.0% | 36.5% |

Importantly, the subject system can maintain the load, either compressive or tensile on an actuator within a narrower range of loads.

Although the present invention has been described and illustrated with respect to preferred embodiments and preferred uses thereof, it is not to be so limited since modifications and changes can be made therein which are within the full, intended scope of the invention as understood by those skilled in the art.

The invention claimed is:

1. A speaker system comprising at least one speaker cabinet, the at least one speaker cabinet comprising:

an enclosure having opposing sidewalls and a connection mechanism attached to each sidewall for connection to at least one adjacent speaker cabinet, each connection mechanism including:

a lever having a first end and a second end, the first end pivotably connected to the enclosure at a pivot point about which the lever is pivotable between a neutral position and an angled position; and an actuator operatively connected to the first end of the lever for pivoting the lever between the neutral position and the angled position;

wherein the lever is configured for connection to an adjacent lower speaker cabinet for changing the angle of the lower speaker cabinet with respect to the at least one speaker cabinet about a horizontal axis;

wherein the pivot point is located along the sidewall to the rear of the center of gravity of the enclosure.

2. The speaker system of claim 1, wherein the lever second ends are located at or substantially adjacent the rear of the enclosure.

3. The speaker system of claim 1, wherein the actuators are linear actuators and a direction of actuation is generally perpendicular to the levers when the levers are in the neutral position.

4. The speaker system of claim 3, wherein the actuators are directly connected to the levers.

5. The speaker system of claim 1, wherein the actuators are connected to the levers via one or more linking members.

6. The speaker system of claim 5, wherein the one or more linking members include at least one second lever operatively connected to the sidewall for reducing the actuation force required to move the levers.

7. The speaker system of claim 5, wherein the actuators have a direction of actuation generally parallel to the levers in the neutral position.

8. The speaker system of claim 1, wherein the actuators have a direction of actuation generally parallel to the levers in the neutral position, and the actuators are operatively connected to the lever by a second lever pivotably connected to the sidewall.

9. The speaker system of claim 8, further comprising at least one linking member operatively connected between each lever and second lever.

10. The speaker system of claim 1, wherein in the neutral position, the first levers are positioned for connecting the lower speaker cabinet at a 0° angle to the at least one speaker cabinet.

11. The speaker system of claim 10, wherein in the angled position, the first levers are positioned at approximately a 10° angle with respect to the at least one speaker cabinet.

12. The speaker system of claim 1, wherein at least two speaker cabinets are stacked vertically to form a line array and the levers of an upper speaker cabinet are operatively connected to the connection mechanisms of a lower speaker cabinet for pivoting the lower speaker cabinet with respect to the upper speaker cabinet about a horizontal axis.

13. The speaker system of claim 1, further comprising a control system for controlling the movement of the actuators.

14. The speaker system of claim 13, wherein the actuators operate substantially simultaneously by means of the control system.

15. The speaker system of claim 1, wherein the actuators are remote controllable.

16. The speaker system of claim 1, further comprising a waveguide having two waveguide walls, each waveguide wall independently and pivotably connected to the front side of the enclosure for directing a sound array from the speaker cabinet.

17. The speaker system of claim 16, wherein each waveguide wall is pivotable between 15° and 70° about a vertical axis from a line bisecting the speaker cabinet.

18. The speaker system of claim 16, further comprising a pair of waveguide actuators, each waveguide actuator operatively connected to one of the waveguide walls and to the enclosure for pivoting the waveguide wall.

19. The speaker system of claim 1, wherein the connection mechanism further comprises a stopping device for preventing the lever from pivoting beyond a maximum angle.

20. The speaker system of claim 19, wherein the stopping device includes at least one slot and pin.

21. A speaker system comprising at least one speaker cabinet, the at least one speaker cabinet comprising:

an enclosure having opposing sidewalls and a connection mechanism attached to each sidewall for connection to at least one adjacent speaker cabinet, each connection mechanism including:

a first lever having a first end and a second end, the first end pivotably connected to the enclosure at a first pivot point about which the lever is pivotable between a neutral position and an angled position;

a second lever pivotably connected to the enclosure at a second pivot point and operatively connected to the first lever via at least one linking member; and an actuator operatively connected to the second lever for pivoting the second lever to cause the first lever to move between the neutral position and the angled position;

wherein the first lever is configured for connection to an adjacent lower speaker cabinet for changing the angle of the lower speaker cabinet with respect to the at least one speaker cabinet about a horizontal axis;

wherein the first pivot point is located along the sidewall to the rear of the center of gravity of the enclosure.

22. A method for automatically adjusting a sound array field on a vertical and a horizontal plane for a vertical line array speaker system, the method comprising the step of:

providing the speaker system so as to comprise at least one speaker cabinet, the at least one speaker cabinet comprising an enclosure having opposing sidewalls and a connection mechanism attached to each sidewall for connection to at least one adjacent speaker cabinet, each connection mechanism including a first lever having a first end and a second end, the first end pivotably connected to the enclosure at a first pivot point about which the lever is pivotable between a neutral position and an angled position, a second lever pivotably connected to the enclosure at a second pivot point and operatively connected to the first lever via at least one linking member and an actuator operatively connected to the second lever for pivoting the second lever to cause the first lever to move between the neutral position and the angled position, wherein the first lever is configured for connection to an adjacent lower speaker cabinet for changing the angle of the lower speaker cabinet with respect to the at least one speaker cabinet about a horizontal axis and wherein the first pivot point is located along the sidewall to the rear of the center of gravity of the enclosure and the method further comprising the steps:

a) assembling a plurality of speaker cabinets to form a vertical line array speaker system and stacking or suspending the speaker system in a venue;

b) inputting into a computer system a 3-dimensional plot of the venue and the location of each speaker cabinet;

c) assigning virtual microphones throughout the venue where an audience would be located;

d) measuring 3-dimensional polar dispersion for a first speaker cabinet using the virtual microphones, wherein the first speaker cabinet is the uppermost speaker cabinet in the vertical line array speaker system;

e) automatically adjusting the sound dispersion field for the first speaker cabinet to optimize the 3-dimensional polar dispersion of the first speaker cabinet; and f) repeating steps d) and e) for each speaker cabinet in the vertical line array speaker system, proceeding from the uppermost speaker cabinet to the lowermost speaker cabinet.

23. The method as in claim 22 wherein, in step e) the sound dispersion field for each speaker cabinet is adjusted horizontally and vertically.

24. The method as in claim 22, wherein in step b), the location of each speaker cabinet is automatically calculated by inputting the specifications of the vertical line array speaker system.

25. The method as in claim 22, wherein in step b), the location of the audience in the venue is inputted into the computer system.

26. The method as in claim 22, wherein in step a), a plurality of vertical line array speaker systems are stacked or suspended in the venue, and steps d) to f) are repeated for each vertical line array speaker system.

* * * * *